US007906318B2

(12) United States Patent
Nakajima et al.

(10) Patent No.: US 7,906,318 B2
(45) Date of Patent: Mar. 15, 2011

(54) TESTING MICROREACTOR, TESTING DEVICE AND TESTING METHOD

(75) Inventors: Akihisa Nakajima, Sagamihara (JP); Eiichi Ueda, Akishima (JP); Kusunoki Higashino, Osaka (JP); Yasuhiro Sando, Amagasaki (JP); Nobuhisa Ishida, Kyoto (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 1118 days.

(21) Appl. No.: 11/121,096

(22) Filed: May 4, 2005

(65) Prior Publication Data

US 2005/0250200 A1 Nov. 10, 2005

(30) Foreign Application Priority Data

May 7, 2004 (JP) ..... 2004-138959

(51) Int. Cl.
*C12M 1/34* (2006.01)

(52) U.S. Cl. ..... 435/287.2; 435/288.5; 435/293.1; 422/130

(58) Field of Classification Search ..... 435/293.1; 422/130; 204/602, 603, 604
See application file for complete search history.

(56) References Cited

U.S. PATENT DOCUMENTS 5,958,344 A 9/1999 Levine et al.
6,197,595 B1 3/2001 Anderson et al.
6,235,471 B1 5/2001 Knapp et al.
6,274,337 B1 8/2001 Parce et al.
6,637,463 B1 * 10/2003 Lei et al. ..... 137/803
6,706,519 B1 * 3/2004 Kellogg et al. ..... 435/287.2
2002/0187564 A1 * 12/2002 Chow et al. ..... 436/518
2004/0053290 A1 * 3/2004 Terbrueggen et al. ..... 435/6
2005/0019902 A1 * 1/2005 Mathies et al. ..... 435/287.2
2005/0092662 A1 * 5/2005 Gilbert et al. ..... 210/97
2006/0205085 A1 * 9/2006 Handique et al. ..... 436/177
2006/0240548 A1 * 10/2006 Deutsch et al. ..... 435/305.2

OTHER PUBLICATIONS

Communication dated Oct. 23, 2009, and European Search Report from the European Patent Office dated Oct. 15, 2009, for Application No. EP 05737310.2, 4 pages.

* cited by examiner

*Primary Examiner* — William H Beisner
*Assistant Examiner* — Michael Hobbs
(74) *Attorney, Agent, or Firm* — Finnegan, Henderson, Farabow, Garrett & Dunner, L.L.P.

(57) ABSTRACT

A micro-reactor for analyzing a sample, comprises (1) a plate-shaped chip; (2) a plurality of regent storage sections each having a chamber to store respective agents; (3) a regent mixing section to mix plural regents fed from the plurality of regent storage sections so as to produce a mixed reagent; (4) a sample receiving section having an injection port through which a sample is injected from outside; and (5) a reacting section to mix and react the mixed regent fed from the reagent mixing section and the sample fed from the sample receiving section. The plurality of regent storage sections, the regent mixing section, the sample receiving section and the reacting section are incorporated in the chip and are connected through flow paths, and the regent mixing section includes a feed-out preventing mechanism to prevent an initially-mixed regent from being fed out to the reacting section.

19 Claims, 19 Drawing Sheets

FIG. 4 ( a )
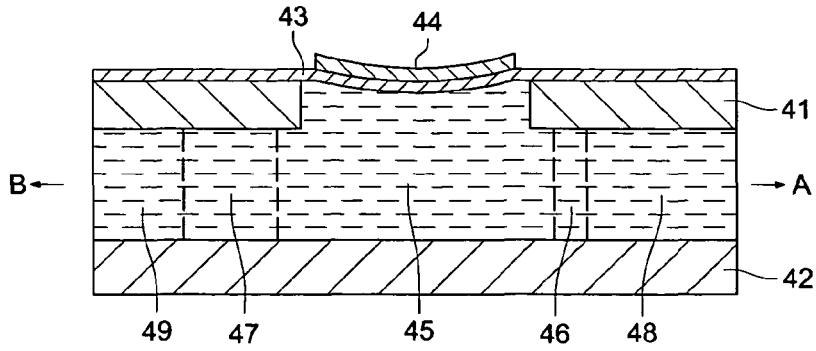
FIG. 4 ( b )
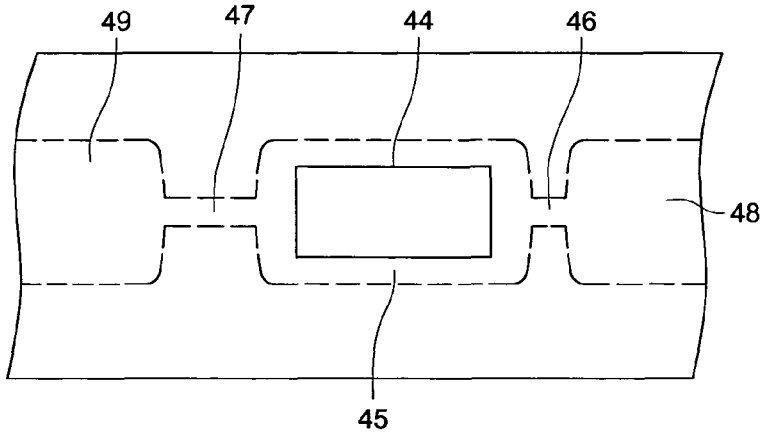
FIG. 4 ( c )
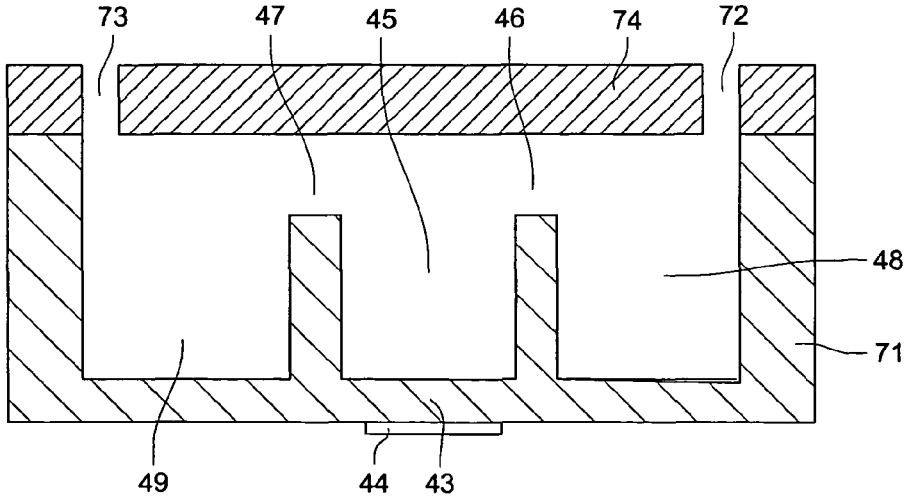

FIG. 5 ( a )
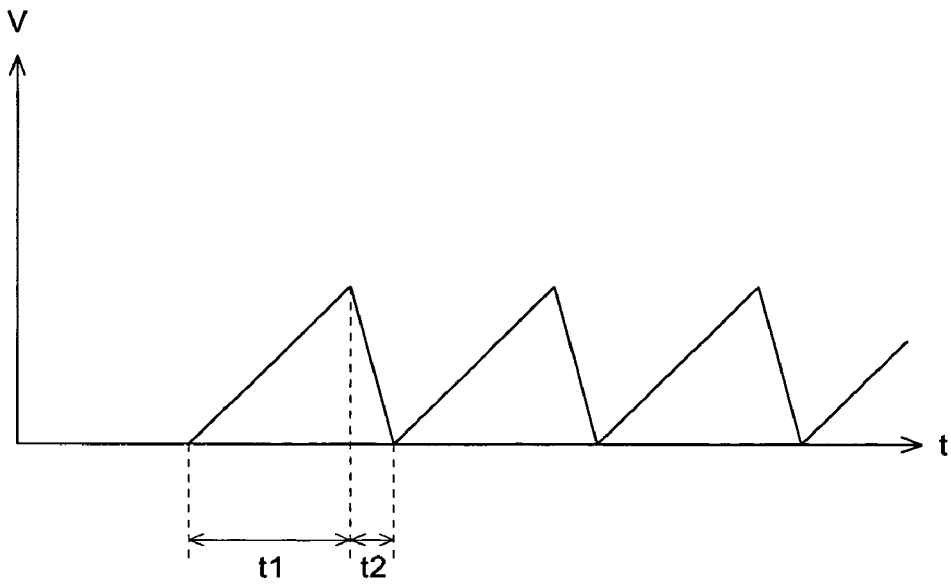
FIG. 5 ( b )
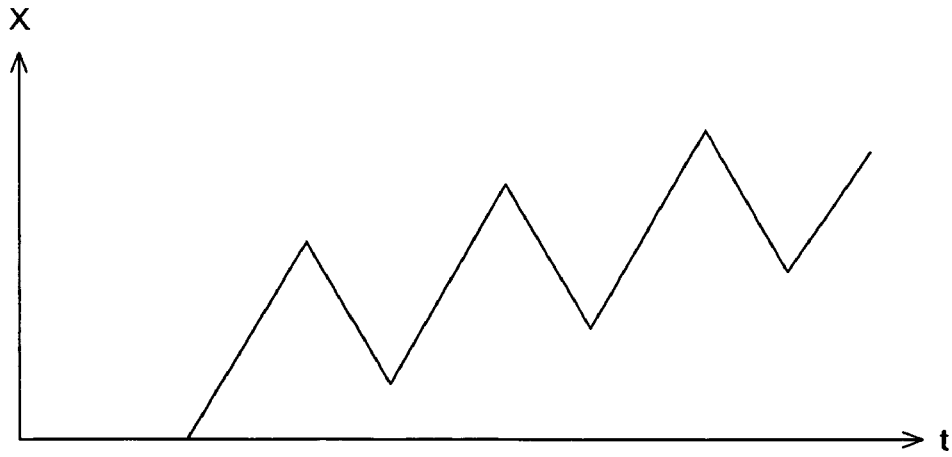

FIG. 9 ( a )
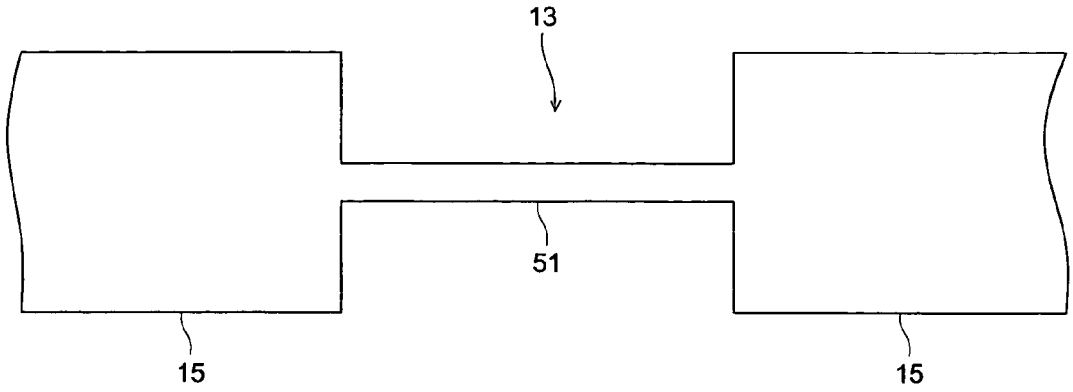
FIG. 9 ( b )
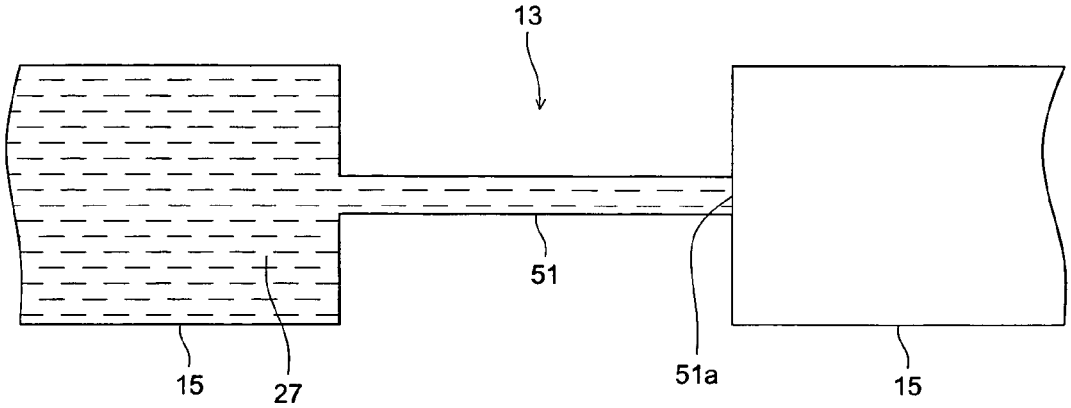

FIG. 18 ( a )
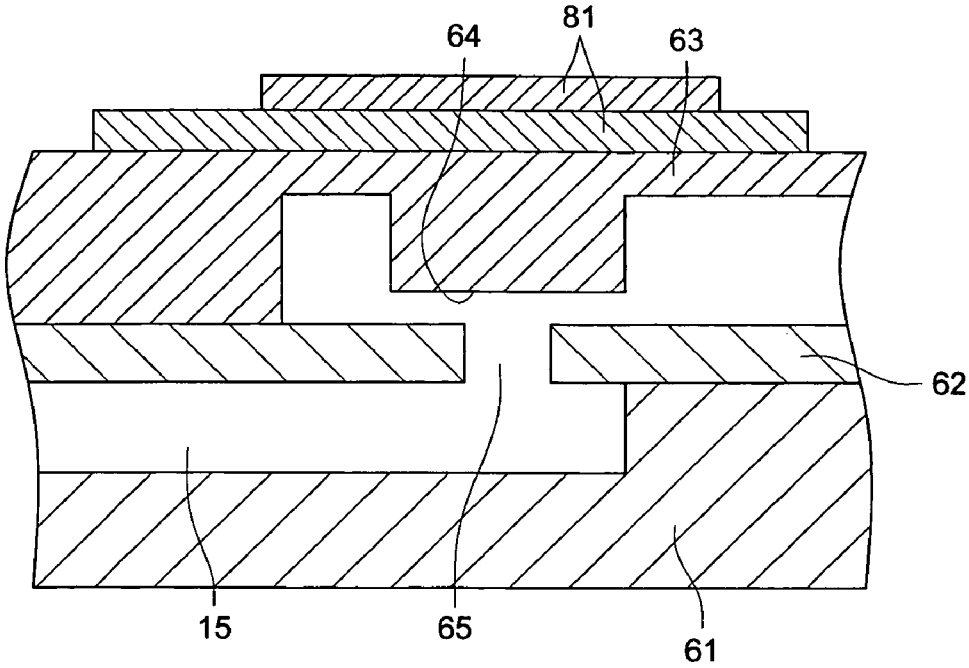
FIG. 18 ( b )
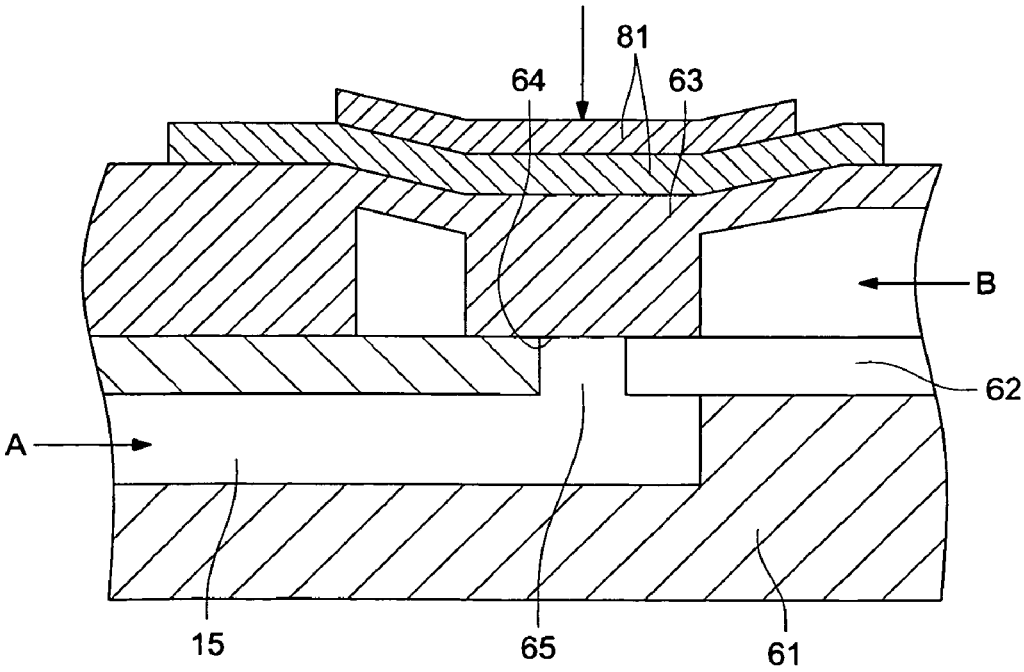

FIG. 19 ( a )
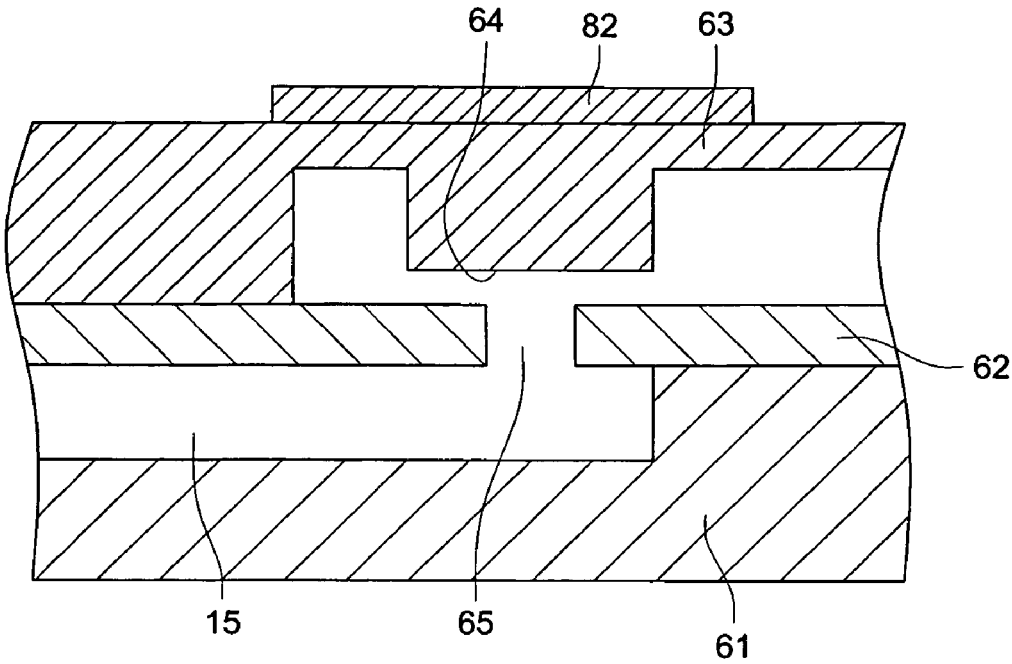
FIG. 19 ( b )
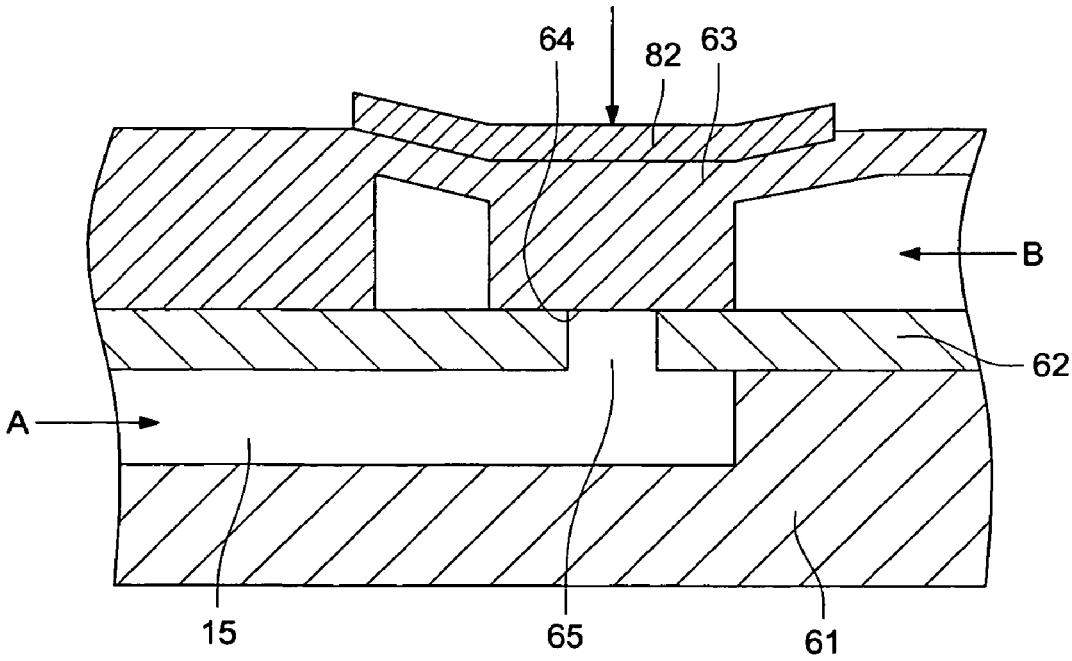

TESTING MICROREACTOR, TESTING DEVICE AND TESTING METHOD

This application claims priority from Japanese Patent Application No. JP2004-138959 filed on May 7, 2004, which is incorporated hereinto by reference.

BACKGROUND OF THE INVENTION

This invention relates to a microreactor and particularly to a gene testing device including a bioreactor which can be favorably used for gene testing.

In recent years, due to the demands of micro-machine technology and microscopic processing technology, systems are being developed in which devices and means (for example pumps, valves, flow paths, sensors and the like) for performing conventional sample preparation, chemical analysis, chemical synthesis and the like are caused to be ultra-fine and integrated on a single chip. This is also called μ-TAS (Micro Total Analysis System) bioreactor, lab-on-chips, and biochips, and much is expected of their application in the fields of medical testing and diagnosis, environmental measurement and agricultural manufacturing. As seen in gene testing in particular, in the case where complicated steps, skilful operations, and machinery operations are necessary, a microanalysis system which is automatic, has high speed and simple is very beneficial not only in terms of cost, required amount of sample and required time, but also in terms of the fact that it makes analysis possible in cases where time and place cannot be selected.

For example, for the new contagious diseases seen in humans and animals, identifying the virus or bacteria which cause these diseases is the first barrier to finding preventative measures within a very limited time. While conventional detection methods tend to be limited by the cultivation of bacteria, gene testing technology which quickly produces results in the case where location is predetermined, responds to the urgent demands. Furthermore, there is a great need for gene testing in diagnosis of genetic diseases, illness risk measurement for lifestyle diseases, and in genetic medicine.

In clinical testing, the quantitative properties of the analysis, accuracy of the analysis and economic factors with respect to the analyzing chip in the clinical examination will be of great importance. As a result, the task at hand is to ensure a feeding system which has a simple structure and is highly reliable. A micro fluid control element which has high accuracy and excellent reliability is desired. The inventors of this invention have already proposed a micro pump system which is suitable for this (Patent Documents 1 and 2).

In addition, chips which are designed to be disposable are desired for use for large numbers of clinical samples, and in addition, problems of multipurpose application and manufacturing cost must also be surmounted.

In a DNA chip in which many DNA fragments are fixed with high accuracy, there are problems relating to information content, increasing production cost, detection accuracy and insufficient replication. However, depending on the purpose and type of genetic screening, tracking the efficiency of the DNA amplification reaction using a primer which can change suitably in real time is more likely to provide a simple and quick testing method than the system in which multiple DNA probes are disposed over the entire chip substrate.

Japanese Patent Application Laid-Open No. 2001-322099 publication

Japanese Patent Application Laid-Open No. 2004-108285 publication

"DNA Chip Technology and Applications" "Proteins, Nucleic Acids and Enzymes" Volume 43 Issue 14 (1998) Published by Fusao Kimizuka and Ikunoshishin Kato, Kyoritsu Publishing Company

SUMMARY OF THE INVENTION

An object of the present invention is to provide a microreactor which is low cost and designed to be disposable and has a feeding system having a simple structure with high accuracy so as to make highly accurate detection possible, in particular, to provide a microreactor for testing gene. An object of this invention is also to provide a bio-microreactor having a structure which makes occurrence of problems such as cross-contamination and carry-over contamination unlikely.

The gene testing device of this invention was conceived in view of the above-described situation and performs the type of DNA amplification in which the primer and bioprobe used can change appropriately in order to ensure multipurpose use and high speed.

The above object can be achieved by the following structures.

A micro-reactor for analyzing a sample, comprising:

(1) a plate-shaped chip;

(2) a plurality of regent storage sections each having a chamber to store respective agents;

(3) a regent mixing section to mix plural regents fed from the plurality of regent storage sections so as to produce a mixed reagent;

(4) a sample receiving section having an injection port through which a sample is injected from outside; and (5) a reacting section to mix and react the mixed regent fed from the reagent mixing section and the sample fed from the sample receiving section;

wherein the plurality of regent storage sections, the regent mixing section, the sample receiving section and the reacting section are incorporated in the chip and are connected through flow paths, and wherein the regent mixing section includes a feed-out preventing mechanism to prevent an initially-mixed regent from being fed out to the reacting section.

In the above micro-reactor, the regent mixing section comprises a mixing flow path and a feed-out flow path to feed out the mixed reagent to the reacting section, and wherein the feed-out flow path is branched from a middle point of the mixing flow path so that the initially-mixed reagent is accommodated in a portion of the mixing flow path between the middle point and a downstream end of the mixing flow path.

In the above micro-reactor, the regent mixing section further comprises a feed-out control section provided at the middle point of the mixing flow path so as to connect the mixing flow path and the feed-out flow path, and wherein the feed-out control section allows the mixed reagent to pass from the mixing flow path to the feed-out flow path when an inner pressure in the mixing flow path becomes higher than a predetermined pressure.

A micro-reactor for analyzing a sample, comprising:

(1) a plate-shaped chip;

(2) a plurality of regent storage sections each having a chamber to store respective agents;

(3) a regent mixing section to mix plural regents fed from the plurality of regent storage sections so as to produce a mixed reagent;

(4) a sample receiving section having an injection port through which a sample is injected from outside; and (5) a reacting section to mix and react the mixed regent fed from the reagent mixing section and the sample fed from the sample receiving section;

wherein the plurality of regent storage sections, the regent mixing section, the sample receiving section and the reacting section are incorporated in the chip and are connected through flow paths, and wherein each of the plurality of regent storage sections has an injecting port through which a driving liquid is injected in the chamber and an exit port through which a stored reagent is extruded from the chamber by the injected driving liquid, the injecting port is jointed with a pump connecting section capable of connecting with a external pump so that the driving liquid is injected in the chamber through the injecting port by the external pump, and an air vent path having an open end is provide on a joint section between the pump connecting section and the injecting port.

BRIEF DESCRIPTION OF THE DRAWINGS

FIG. 4 shows a piezo pump and FIG. 4 (*a*) is a cross-sectional view of an example of this pump while FIG. 4 (*b*) is a top view thereof. FIG. 4 (*c*) is cross-sectional view of another example of the piezo pump.

FIG. 5 is a graph showing the relationship between the drive voltage waveform which is applied to the piezo electric element in the pump and the position displacement of the fluid position.

FIGS. 9 (*a*) and (*b*) are cross-sectional views in the flow path axial direction of the feed control section 13.

FIG. 18 is a cross-sectional view of an example active valve provided in the flow path, and FIG. 18 (*a*) shows an open state of the valve while FIG. 18 (*b*) shows a closed state.

FIG. 19 is a cross-sectional view of an example active valve provided in the flow path, and FIG. 19 (*a*) shows an open state of the valve while FIG. 19 (*b*) shows a closed state.

DETAILED DESCRIPTION OF THE PREFERRED EMBODIMENT

Figure 1:
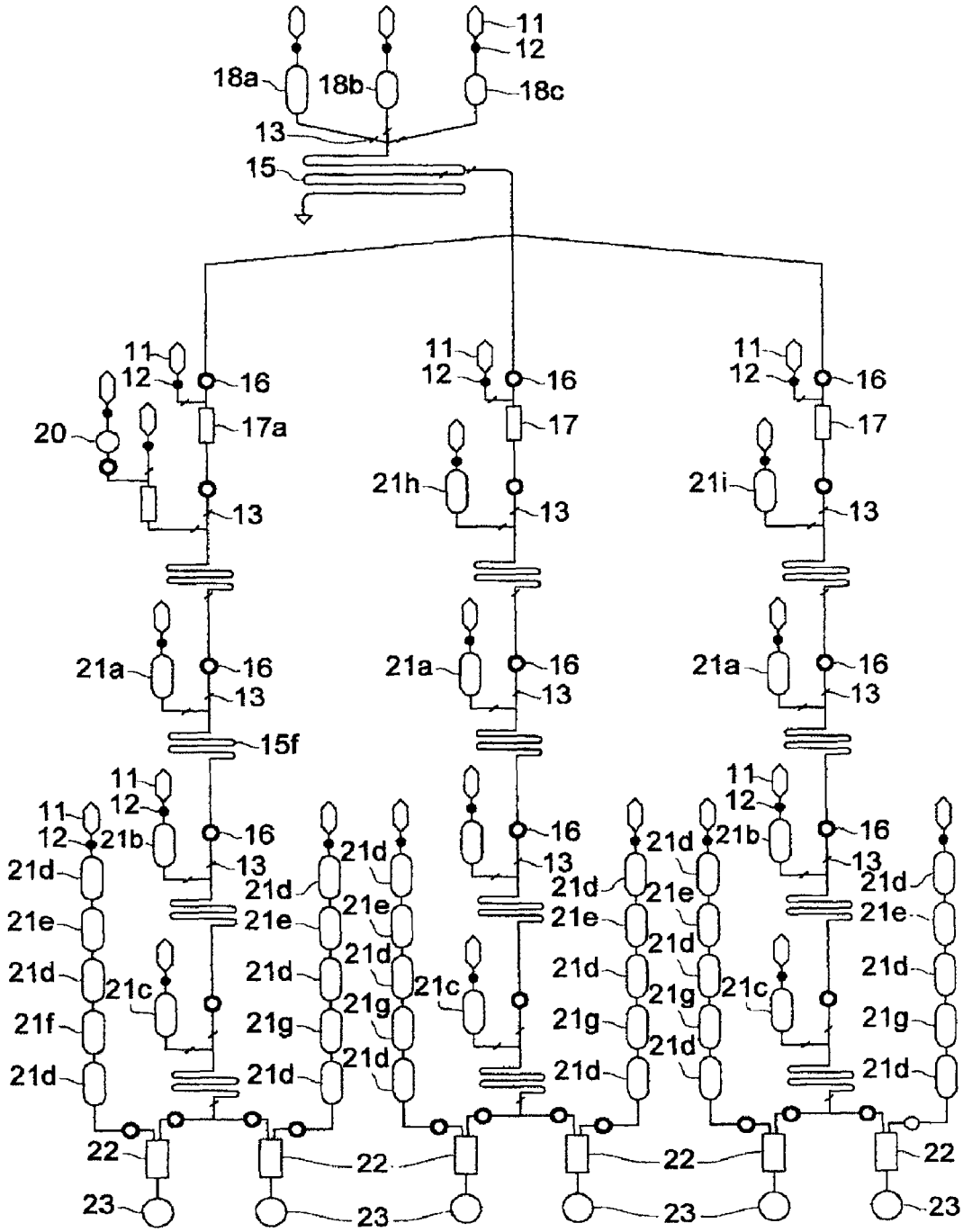
FIG. 1 is a schematic view of the gene testing microreactor of an embodiment of this invention.

Firstly, the above object may be achieved by the following preferable structures.

The gene testing microreactor of this invention comprises on a single chip:

a specimen storage section into which a specimen or DNA extracted from a sample is poured;

a reagent storage section into which the reagent used in the gene amplification reaction is stored;

a positive control storage section into which the positive control is stored;

a negative control storage section into which the negative control is stored;

a probe DNA storage section into which the probe DNA for hybridization with the gene for detection that has been amplified by a gene amplification reaction is stored;

a flow path for causing the storage sections to communicate; and a pump connection portion which can connect with each of the storage sections and with a separate micro-pump which feeds fluid in the fluid flow path, and after the micro pump is connected to chip via the connection portion, and the specimen or the DNA extracted from the specimen stored in the specimen storage section and the reagent stored in the reagent storing section are fed to the flow path and then mixed in the flow path to cause an amplification reaction, the processing fluid resulting from processing the reaction fluid and the probe DNA stored in the probe DNA storage section are fed, and mixed and hybridized in the flow path, and the amplification reaction detection is performed based on the reaction products, and similarly, the positive control stored in the positive control storage section and the negative control stored in the negative control storage section undergo amplification reaction with the reagent stored in the reagent storage section in the flow path, and then hybridization with the probe DNA stored in the probe DNA storage section in the flow path and amplification reaction detection is performed based on the reaction products.

The gene testing microreactor comprises a reverse transcription enzyme storage section into which the specimen or RNA extracted from the specimen stored in the specimen storage section is poured, and which stores the reverse transcription enzyme for synthesizing cDNA from the RNA stored therein using a reverse transcription reaction, and the specimen or the RNA extracted from the specimen stored in the specimen storage section and the reverse transcription enzyme stored in the reverse transcription storage section are fed to the flow path and mixed in the flow path and cDNA is synthesized and then the amplification reaction and the detection thereof is performed.

Also, in the gene testing microreactor, the flow path comprises:

a feed control section which is capable of controlling the passage of fluid by the pump pressure of the micro pump by interrupting the passage of fluid until the feed pressure in the normal direction of flow reaches a preset pressure, and permitting passage of the fluid by applying a feed pressure which is no less than the preset pressure and a reverse flow prevention section for preventing reverse flow of the fluid in the flow path, and the micro pump controls the feed, quantity, and mixing of each of the fluids in the flow path using the feed control section and the reverse flow prevention section.

In addition, the gene testing microreactor comprises a micro flow path which is formed between both sides of adjacent flow paths so as to connect in a straight line and which have a cross-sectional area which is smaller than the cross-sectional area of the adjacent flow paths.

In the gene testing microreactor, the reverse flow prevention section is a check valve in which a valve element closes the opening of the flow path using reverse flow pressure or an active valve in which a valve element is pressed onto the flow path opening portion by a valve element deforming means to close the opening.

The gene testing microreactor comprising a reagent loading flow path which is formed between the reverse flow prevention section and the feed control section, and is capable of loading a prescribed quantity of reagent; and a branched flow path which branches from the reagent loading flow path and communicates with the micro pump which feeds drive fluid and the connected pump connection portion;

and after reagent is loaded by supply of the reagent from the reverse flow prevention section side to the reagent loading flow path by the feed pressure due to the reagent not passing from the from the fluid feed control section forward.

Furthermore, the gene testing microreactor comprises:

a plurality of flow paths for feeding the reagents;

a mixing flow path which is connected to the plurality of flow paths and in which the reagents from these flow paths are mixed;

a branched flow path which branches from the mixed flow path and which feeds the reagent mixture to the next step;

a first feed control section which is disposed at a position beyond the branching point of the branched flow path in the mixing flow path;

a second feed control section which is disposed at a position in the vicinity of the branching point of the mixing flow path in the branched flow path and the feeding pressure which allows the reagent mixture to pass is smaller than that of the first feed control section, and after the reagent mixture is fed until the front end portion of the reagent mixture which is fed in the mixing flow path reaches the first feed control section, the reagent mixture is passed from the second feed control section to the branched flow path at a feed pressure that does not allow the reagent mixture to pass the first feed control section, and then the reagent mixture is fed to the next step.

In the gene testing microreactor, the cross-sectional area of the micro flow paths in the first feed control section is smaller than the cross-sectional area of the micro flow paths in the second feed control section.

In the gene testing microreactor, an air vent path which branches from the flow paths and has an open end is provided in the flow path between the pump connection portion and the storage section in which the content fed by the micro pump connected to the pump connection portion is stored.

In the gene testing microreactor, the reagent used for the gene amplification reaction, the positive control and the negative control are preferably stored in the storage section.

In the gene testing microreactor, the space between the storage section which store the reagent used for the gene amplification reaction, the positive control and the negative control and the flow path communicating therewith is loaded with a sealing agent for preventing leakage of the content of the storage section to the flow path before use.

The sealing agent is preferably formed of a fat which has a solubility in water of not more than 1%.

It is desirable that the sealing agent is formed of a fat which has a solubility in water of not more than 1%, and a melting point of 8° C. to room temperature (25° C.).

The sealing agent is preferably an aqueous solution of gelatin.

In the gene testing microreactor, the reagent used in the gene amplification reaction includes a chimera primer which hybridizes specifically with the gene to be detected, a DNA polymerase having chain substitution activity, and an endonuclease.

A gene testing method of this invention comprises:

a step of feeding the cDNA synthesized by a reverse transcription reaction by the specimen or the DNA extracted from the specimen, or alternatively the specimen or the RNA extracted from the specimen and a biotin modified primer from the respective storage section to the flow path and performing a gene amplification reaction in a flow path;

a step of mixing the reaction solution including the amplified gene and the denaturant and denaturing the amplified gene into a single strand;

a step of feeding the processing solution that has undergone processing for denaturing the amplified DNA to a single strand into a flow path to which streptavidin has been adsorbed and then and fixing the amplified gene;

a step of feeding probe DNA whose end has been modified by FITC into the flow path into which the amplified gene is fixed and hybridizing the fixed gene with the probe DNA;

a step of feeding gold colloid whose surface has been modified with a FITC antibody into the flow path and adsorbing gold colloid into the probe which has been hybridized with the fixed gene;

and a step of optically measuring the concentration of the gold colloid in the flow path, using any of the microreactors described above.

It is preferable that a step of feeding rinsing solution in the flow path in which streptavidin is adsorbed is included if necessary between each of the steps.

The gene testing device of this invention comprises one of the microreactors and a micro pump for connection to the pump connection portion of the microreactor.

The gene testing device comprises:

a first flow path in which the micro pump changes the flow path resistance in accordance with pressure difference;

a second flow path in which the change ratio for the flow path resistance with respect to the change in pressure difference is less than that for the first flow path;

a pressure chamber which is connected to the first flow path and the second flow path;

an actuator for changing the internal pressure of the pressure chamber; and a driving device for driving the actuator.

In the gene testing device, a pump connection portion is provided at the upstream side of each reagent storage section in which the reagent is stored and a micro pump is connected to the pump connection portions, and reagent is pushed out from the reagent storage section to the flow path by supplying drive fluid from each micro pump to start the gene amplification reaction.

In the gene testing device, the reagents are mixed at a desired ratio by controlling the operation of the actuator using drive signals from the driving device of the micro pump.

The gene testing device preferably comprises a detection device for detecting the amplification reaction based on the reaction products of hybridization of the amplified gene and the probe DNA.

The gene testing preferably comprises a temperature control device for controlling the reaction temperature for each reaction in the flow path of the microreactor.

The gene testing device comprises a device main body in which the micro pump, the detector device and the temperature control device are integrally formed and a microreactor which can be installed on the device main body, and gene amplification reaction and the gene amplification reaction detection are automatically performed by installing the microreactor on the device main body.

The microreactor of this invention has a structure which is suitable for large volume production, and furthermore because application is universal for multiple purposes, it can be manufactured at a low cost. In addition, because the flow path system including pumps and valves has a simple structure, it is difficult for air to enter the system and there is little dead volume and thus feeding accuracy is high. Because a DNA amplification step is included at the time of detection, the bioreactor is capable of high accuracy detection.

Because the analysis reactor can realize reverse transcription not only for DNA analysis, but also for RNA, sample preparation is easy and even an extremely small quantity can be analyzed with high accuracy in a short time.

In addition, because the system structure of the gene testing device of this invention is such that the reagents/feeding system element loading component and the control/detection component for each sample are separate, occurrence of serious problems such as cross contamination and carry over contamination is unlikely for the small quantity analysis and the amplification reaction. Because the rinsing method for non-specific binding substances other than primer and probe binding with the sample DNA (or interaction) is easy, a microreactor chip with a low background can be provided.

This invention may be used in gene expression analysis, gene function analysis, single nucleotide polymorphism analysis (SNP), medical screening, medicine, testing of the safety/toxicity of agricultural chemicals and various chemical substances, clinical diagnosis in medicine, food inspection, forensic medicine, chemistry, brewing, forestry, fishery, stock breeding, agricultural manufacturing and the like.

Embodiments of this Invention

The following is a description of the microreactor of this invention; the gene testing device comprising the microreactor, various control devices and a detection device; and the gene testing method including the gene amplifications steps and detection steps.

Microreactor and Gene Testing Device

Figure 2:
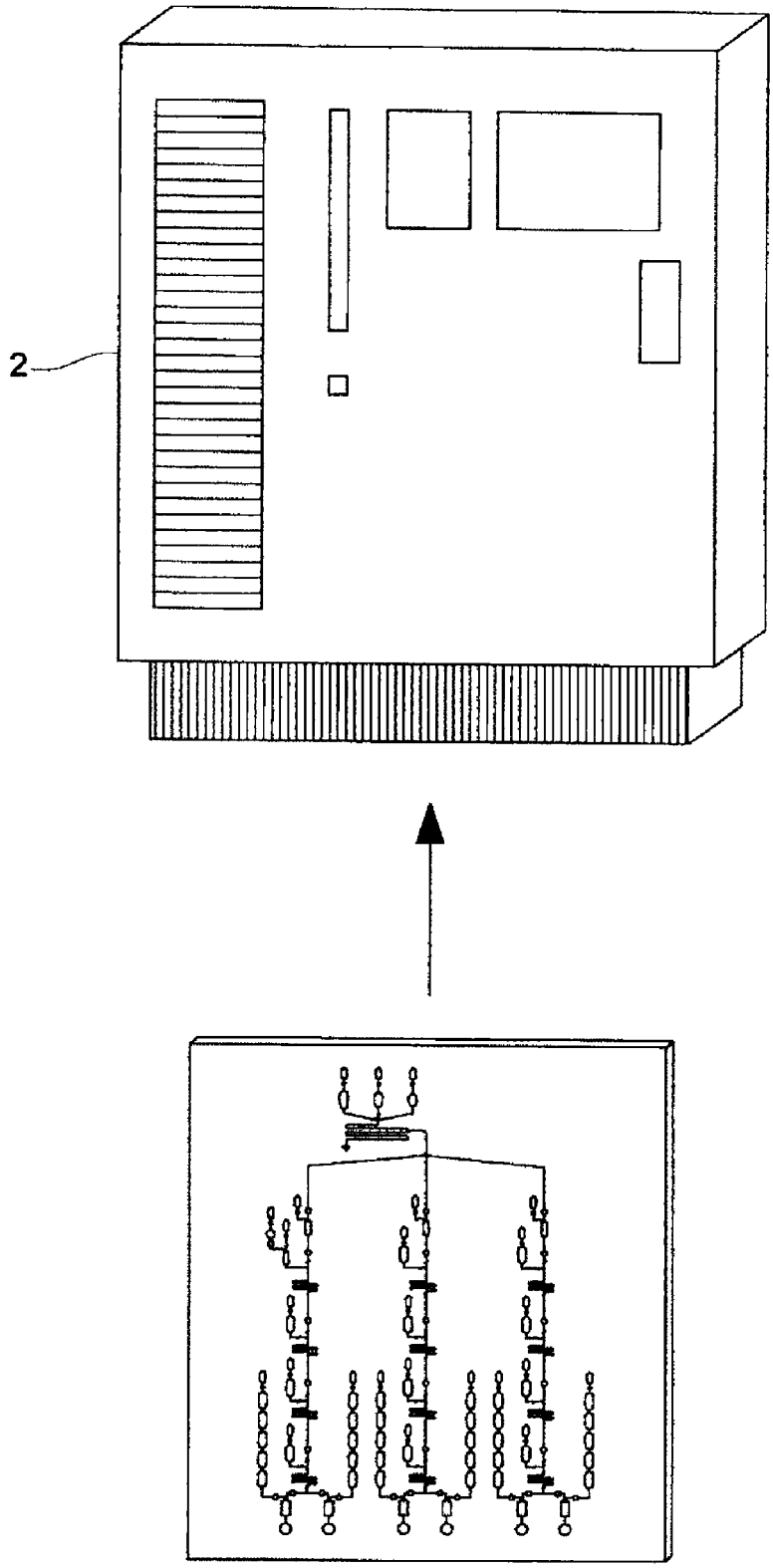
FIG. 2 is a schematic view of the gene testing device comprising the microreactor and the device main body of FIG. 1.

The microreactor and gene testing device of this invention will be described with reference to the drawings. FIG. 1 is a schematic view of the microreactor for the gene testing device of an embodiment of this invention and FIG. 2 is a schematic view of the gene testing device comprising the microreactor and the device main body of an embodiment of this invention.

The microreactor shown in FIG. 1 comprises a single chip made of resin, glass, silicon, ceramics and the like. The chip comprises specimen storage sections, reagent storage sections, probe DNA storage sections, control storage sections, flow paths, pump connection sections, feed control sections, reverse flow prevention sections, reagent assay section, and each of the mixing sections is disposed at a functionally suitable position using micro-processing technology. Furthermore, if necessary, a reverse transcription enzyme section may be installed. The specimen storage section communicates with the specimen introduction section and temporarily stores the specimen and supplies the specimen to the mixing section. In some cases, the specimen storage section may have the effect of blood cell separation. Mixture of reagent and reagent, and mixture of specimen and reagent can be done in a single mixing section at a prescribed ratio or alternatively, one or both may be divided and a plurality of converging sections provided and mixing is done so as to achieve a final desired mixing ratio.

By introducing a specimen such as blood or the like into the specimen storage section of the microreactor, the processes necessary for gene amplification and detection thereof are automatically performed in the chip, and gene testing can be done simultaneously for multiple items in a short period of time. In the aspect of the preferable gene testing device used in the microreactor of this invention, the necessary reagents are sealed in advance in a prescribed quantity, and the microreactor is used as a unit for performing a prescribed amplification and detection of the amplification products for the DNA or RNA of each specimen.

Meanwhile, the unit which handles the control system for controlling the feeding, temperatures and reactions, optical detection, data collection and processing comprises micro pumps, optical devices and the main body of the gene testing device of this invention. Installing the above-described chip on the device main body allows shared use for the specimen sample. Thus, processing can be done efficiently and quickly even for multiple samples. In the prior art technology when analysis for different content or synthesis and the like is performed, a micro fluid device corresponding to the content to be changed needed to be configured each time. Unlike that case, in this invention it is sufficient to simply replace the detachable chip. Also if it is necessary to change control of the device elements, the control program stored in the device main body can simply be altered.

Because each of the components of the gene testing device of this invention has a form that is compact and convenient for handling, the components are not limited in terms of location and time of use and thus workability and operation properties are favorable.

The outline of the microreactor and the screening device of this invention was described above, but suitably selected modifications and variations of the various embodiments of this invention which are within the general principles of this invention is possible and these are included in this invention. In other words, structure, configuration, arrangement, shape, dimensions, material system, method and the like of a portion or of the entire microreactor and screening device of this invention may vary provided that they are consistent with the general principles of the invention.

Gene Amplification Step/Sample

The specimen of this invention to be determined is a gene, DNA or RNA as the nucleic acid which is the matrix for the amplification reaction in the case of gene testing. The sample may also be one prepared or isolated from a sample which may include this type of nucleic acid. The method for preparing genes, DNA or RNA from this sample is not particularly limited and known techniques may be used. In recent years, techniques for preparing genes, DNA or RNA from a living sample for gene amplification have been developed and these may be used in the form of a kit or the like.

The sample itself is not particularly limited and includes almost all samples of biological origin such as whole blood, serum, Buffy coat, urine, feces, saliva and sputum; samples including nucleic acid such as cell cultures, viruses, bacteria, mold, yeast, plants and animals; samples that may include, or into which microorganism are blended; and various other samples that may include other nucleic acids.

The DNA can be separated from the sample and purified in accordance with a usual method by phenol chloroform extraction and ethanol sedimentation. Use of a high concentration chaotropic sample such as guanidine hydrochloride and isothiocyanic chloride which is near saturation concentration for isolating nucleic acid is generally known. A method, in which the specimen is directly processed with a protein decomposition enzyme solution including a surfactant (PCR Experiment Manual by Takashi Saito, published by HBJ publishers 1991, P309), rather than using the phenol chloroform extraction described above, is simple and quick. In the case where the genome DNA or the gene-obtained is large, a suitable control enzyme such as BamHI, BgLII, DraI, EcoRI, EcoRV, HindIII, PvuII and the like and performing fragmentation according to a conventional method. In this manner, DNA and aggregates of fragments thereof can be prepared.

The RNA is not particularly limited provided that the primer used in the transcription reaction can be produced. Aside from whole RNA, RNA molecule groups such as retroviral RNA which functions as a gene, mRNA or rRNA which are direct information transmission carriers for the expressed gene can be screened. These RNAs may be converted to cDNA using a suitable reverse transcription enzyme and then analyzed. The method for preparing mRNA can be done based on known technology and reverse transcription enzymes are readily available.

The quantity of sample required in the microreactor of this invention is much less than that for the operation using the device of the prior art. For example, in the case of a gene, the quantity of DNA required is 0.001 to 100 ng. As a result, there are no limitations in terms of the sample for use of the microreactor of this invention including case where only an extremely small quantity of sample can be obtained, and when the quantity is inevitably small because of the nature of the sample, and thus screening cost is reduced. The sample is introduced from the introduction section of the "specimen storage section" described above.

Amplification Method

The amplification method in the microreactor of this invention is not particularly limited. For example the DNA amplification method may be the PCR amplification method which is used extensively in a wide range of applications. The various conditions for implementing the amplification technology have been studied in detail, and are described along with modifications in various documents. In PCR amplification, temperature control in which temperature is increased and decreased between 3 temperatures is necessary, but a flow path device which is capable of favorable control of the microchip has already been proposed by the inventors of this invention (Japanese Patent Application Laid-Open 2004-108285). This system device should be used in the amplification flow path of the chip of this invention. As a result, because the heat cycle can be switched to a high speed and the micro flow path functions as a micro reaction cell having low heat volume, the DNA amplification is performed in much less time than the conventional system in which DNA amplification is performed manually using a micro tube, a micro vial or the like.

In the recently developed ICAN (isothermal chimera primer initiated nucleic acid amplification) in which the complicated temperature controls of PCR reaction is unnecessary, the DNA amplification can be carried out is a short time at a suitably selected fixed temperature which is 50° C. to 65° C. (Japanese Patent No. 3433929). Accordingly, the ICAN method is a suitable amplification technique for the microreactor of this invention because the temperature control is simple. The method which takes 1 hour for manual operation, takes 10 to 20 minutes and preferably 15 minutes to completion of analysis in the bioreactor of this invention.

The DNA amplification reaction may be other modified PCR methods, and the microreactor of this invention has the flexibility of handling these methods by changing the flow path settings. In the case where any of the DNA amplification reactions is used also, details of the techniques are disclosed and can be easily introduced by one skilled in the art.

Reagents (i) Primer

The PCR primer is 2 types of complementary oligonucleotide on both ends of the DNA strand with a specific site for amplification. The settings have already been developed by dedicated applications and one skilled in the art can easily make the primer using a DNA synthesizer or a chemical synthesizer. The primers for the ICAN method are the DNA and RNA chimera primer and the preparation method for these substances have already been technologically established (Japanese Patent No. 3433929). It is important that the setting and selection of the primer is such that most suitable substance for affecting the results and efficiency of the amplification reaction is used.

In addition, if biotin is bound with the primer, the amplified DNA product can be fixed on a substrate via binding of streptavidin with the substrate and a fixed quantity of the amplification product can be supplied. Other examples of primer marker substances include digoxigenin and various fluorescent dyes.

(ii) Reagents for Amplification Reaction

The enzymes which are the reagents primarily used in the amplification reaction can be readily obtained by any of the PCR or ICAN methods.

Examples of the reagent in the PCR method include at least 2-deoxynucleotide 5'-triphosphate as well as Taq DNA polymerase, Vent DNA polymerase or Pfu DNA polymerase.

The reagents in the ICAN method include at least 2'-deoxynucleotide 5'-triphosphate, a chimera primer that can be hybridized specifically with the gene to be detected, a DNA polymerase having chain substitution activity, and the endonuclease RNase.

(iii) Control

Internal control for the marker nucleic acids (DNA, RNA) is used for amplification monitoring or as an internal standard substance when the quantity is fixed. The sequence of the internal control is such that the primer which is the same as the primer for the specimen can be amplified in the same way as the specimen in order to have a sequence that can be hybridized at both sides of the sequence which is different from the specimen. The sequence of the positive control is a specific sequence which detects the specimen and is the same as that of the specimen in the portion which the primer will hybridize. The nucleic acid used in the control (DNA and RNA) may be any described in a known documents. The negative control includes all reagents other than nucleic acids (DNA, RNA) and are used to check whether there is contamination and for background correction.

(iv) Reagent for Reverse Transcription

In the case of RNA, the reagent for reverse transcription is a reverse transcription enzyme or a reverse transcription primer for synthesizing cDNA from RNA and these are commercially available and easily obtained.

A prescribed quantity of the bases for amplification (2'-deoxynucleotide 5'-triphosphate) and the gene amplification reagent and the like respectively are sealed beforehand in the reagent storage section of one microreactor. Accordingly, when the microreactor of this invention is to be used, it is not necessary to supply the necessary quantity if reagent each time, and thus the device is ready for immediate use.

Detection Method

The DNA detection method for the target gene that has been amplified in this invention is not particularly limited and any suitable method may be used as necessary. A visible light spectrophotometry method, a fluorophotometry method, an emitted luminescence method are considered mainstream as the suitable methods. Further examples include an electrochemical method, surface plasmon resonance, and quartz oscillator microbalance and the like.

The gene testing device of this invention includes the microreactor as well as a detection device for detecting whether there is an amplification reaction and the scale of the reaction based on the reaction products due to hybridization of the amplified gene and the probe DNA.

The method of this invention used in the microreactor is more specifically, performed by the following steps. In other words, the method of this invention is performed using the microreactor and includes (1) a step of feeding the cDNA synthesized by a reverse transcription reaction by the specimen or the DNA extracted from the specimen, or alternatively the specimen or the RNA extracted from the specimen and a biotin modified primer from the respective storage section to the flow path and performing a gene amplification reaction in a flow path; (2) a step of mixing the reaction solution including the amplified gene and the denaturant in the micro tubes and performing processing for denaturing the amplified gene into a single strand; (3) a step of feeding the processing solution that has been processed for denaturing the amplified DNA to a single strand to a flow path to which streptavidin has been adsorbed and then and fixing the amplified gene; (4) a step of flowing probe DNA whose end has undergone fluorescent marking with FITC (fluorescein isothiocyanate) into the micro flow path into which the amplified gene is fixed and hybridizing the fixed gene with the probe DNA; (5) a step of flowing gold colloid whose surface has been modified with a FITC antibody which binds specifically with FITC into the micro flow path and adsorbing gold colloid to the probe; and (6) a step of optically measuring the concentration of the gold colloid in the micro flow path.

In the method described above, fixing by biotin DNA and biotin-streptavidin binding and the FITC fluorescent marking and the like, and the FITC antibody and the like are known technology. It is preferable that a step of feeding rinsing solution into the flow path in which streptavidin is adsorbed is included if necessary between each of the steps. Preferable examples of this rinsing solution include various buffer solutions, saline solutions, organic solvents.

Ultimately, the screening method of this invention is preferably a system which can perform determinations with high sensitivity using visible light. Due to the fluorophotometry, the device is a general use device and hindrances are few and data processing is also easy. Preferably, the optical detection device for fluorophotometry performs detection using the gene testing device of this invention and comprises a feeding means which includes a micro pump and a temperature control device for controlling the reaction temperature for each reaction in the flow paths in the microreactor which are integrally formed.

In the above step, the denaturant is a reagent for forming the genetic DNA into a single strand, and examples include sodium hydroxide, calcium hydroxide and the like. Examples of the probe include oligonucleotides and the like. Aside from FITC, fluorescent substances such as RITC (rodamine isothiocyanate) and the like may be used.

The amplification and detection include software with set conditions for the preset feeding procedure, volume and timing as well as micro pump and temperature control as its program content, and when the detachable microreactor is attached to device main body of the gene testing device in which the micro pump, the detection device and the temperature control device are integrated, the flow path of the reactor switches to the operating state. It is preferable that automatic analysis begins when the sample is poured in, and feeding of the sample and reagents, the gene amplification reaction based on the mixing, the gene detection reaction, and optical measurement are automatically performed as a series of continuous steps, and the measurement data as well as required conditions and recording items are stored in a file.

Gene Testing

By using a primer having a specific sequence in a specific gene as the primer for the amplification reaction, a determination as to whether the DNA originating from the genes in the sample is the same or different from the specific gene can be used by determining whether there is amplification and measuring amplification efficiency. In particular, this is effective for quickly identifying viruses and bacteria causing infectious disease.

Data which examines the level of expression of the cancer gene and the genetic hypertension gene and the like can be obtained using the gene testing of this invention. More specifically, it is an analysis of the type and expression level of the mRNA which is evidence of expression of these genes.

Alternatively, in addition, susceptibility to infection due to specific diseases, gene variation causing side-effects for medicines, coding regions and the like, and variations in regulator gene promoter regions also can be detected by gene testing using the microreactor of this invention. In that case, a primer that has the nucleic acid sequence including the varied portion is used. It is to be noted that gene variation refers to variation of the nucleotide bases of the gene. Furthermore, by using the gene testing device of this invention, analysis of genetic polymorphism is useful in identifying genes for disease susceptibility.

It is clear from the device structure and the analytical principles that the gene testing method used in the gene testing device of this invention obtains more accurate results using a much smaller quantity of specimen and is much less labor-intensive and is a simpler device than the nucleic acid sequence analysis, control enzyme analysis, and nucleic acid hybridization analysis of the prior art.

The microreactor for gene testing and the gene testing device and the like of the present invention may be used in gene expression analysis, gene function analysis, single nucleotide polymorphism analysis (SNP), clinical screening/diagnosis, medical screening, medicine, testing of the safety/toxicity of agricultural chemicals and various chemical substances, environmental analysis, food inspection, forensic medicine, chemistry, brewing, fishery, stock breeding, agricultural manufacturing, forestry and the like.

The embodiments of this invention will be described in the following with reference to the drawings. FIG. 1 is a schematic view of the microreactor for gene testing of an embodiment of this invention and FIG. 2 is a schematic view of the gene testing device comprising the microreactor and the device main body.

The microreactor shown in FIG. 1 is formed of a single chip made of resin and by introducing a specimen such as blood or the like therein, the gene amplification reaction and detection thereof are automatically performed in the chip, and gene diagnosis can be done simultaneously for multiple items. For example, by simply dropping about 2 to 3 μl of blood specimen in a chip having length and width of a few cm and by installing the chip on the device main body 2 of FIG. 2, the amplification reaction and detection thereof can be done.

The specimen that has been poured into the specimen storage section 20 of FIG. 1 and reagent for the gene amplification reaction which has been sealed beforehand in the reagent storage sections 18*a* to 18*c* are fed to the flow paths which communicate with each of the storage sections by the micro pumps (not shown), which are incorporated into the device main body of FIG. 2, and the specimen and the reagents are mixed in the flow path via the Y-shaped flow path and the amplification reaction is performed. The flow path is formed so as to have a width of about 100 μm and a depth of about 100 μm, and the detection reaction is detected by the optical detection device (not shown) which is incorporated in the device main body 2 of FIG. 2. For example, a measuring beam is irradiated from a LED into the flow path for each item to be detected, and due to detection by transmitted light or reflected light from an optical detection means such as a photodiode or a photomultiplier, the probe DNA is hybridized and as a result the marked DNA (gene) is detected.

The main body device 2 has a temperature control device for controlling reaction temperature incorporated therein, and by simply installing the chip into which reagents have been sealed in advance onto the compact unit into which the feeding pump, the optical detection device and the temperature control device are integrally formed, gene diagnosis can be done simply. In this manner, because determination can be done quickly without concern for time and place, use for emergency treatment or for personal use such as home treatment is possible. Because multiple micro pump units used for feeding and the like are incorporated at the device main body side, the chip is disposable.

The following is a more specific description of the configuration of the microreactor based on the microreactor of the embodiment of this invention shown in FIGS. 14 to 17. The microreactor of this embodiment preferably performs the amplification reaction using the ICAN method, and the gene amplification reaction is performed in the microreactor using a specimen extracted from blood or sputum, a reagent including a biotin modified chimera primer for specific hybridization of the gene to be detected, a DNA polymerase having strand activity, and an endonuclease. The reaction fluid is fed into a flow path into which streptavidin that has been modified is adsorbed and the amplified gene is fixed in the flow path. Next, the probe DNA whose end has been modified by fluorescein isothiocyanate (FITC) and the fixed gene are hybridized and gold colloid whose surface has been modified with a FITC antibody is adsorbed to the probe which has been hybridized with the fixed gene, and the concentration of the gold colloid is optically measured to thereby detect the amplified gene.

In this embodiment, the microreactor is configured as described in the following so that gene testing can be performed quickly and with high accuracy and high reliability on a single chip. Firstly, all the controls are integrated on a single chip, and the internal control, the positive control and the negative control are sealed beforehand in a microreactor and the amplification reaction and the detection operation for the controls are performed simultaneously with the amplification reaction and the detection operation for the specimen. As a result, gene testing can be performed speedily and is highly reliable.

Secondly, a feed control section which is capable of controlling the passage of fluid by the pump pressure of the micro pump by interrupting the passage of fluid until the feed pressure in the normal direction of flow reaches a preset pressure, and permitting passage of the fluid by applying a feed pressure which is greater than or equal to the preset pressure and a reverse flow prevention section for preventing reverse flow of the fluid in the flow path is provided at each flow path position. As described below, the feeding of the fluid in the flow path is controlled by the micro pumps, the feed control section and the reverse flow prevention sections, and a fixed quantity of the reagent and the like can be fed with high accuracy and the multiple reagents which are introduced from the branched flow paths can be quickly mixed.

The main structural elements of the microreactor will be described before describing the amplification reaction and the detection operation used in the microreactor of this embodiment.

Reagent Storage Section

The microreactor is provided with a plurality of reagent storage section for storing each of the reagents, and the reagent used in the gene amplification reaction, the denaturant used for denaturing the amplified gene, the probe DNA which is hybridized with the amplified gene are stored in the reagent storage sections.

Figure 3:
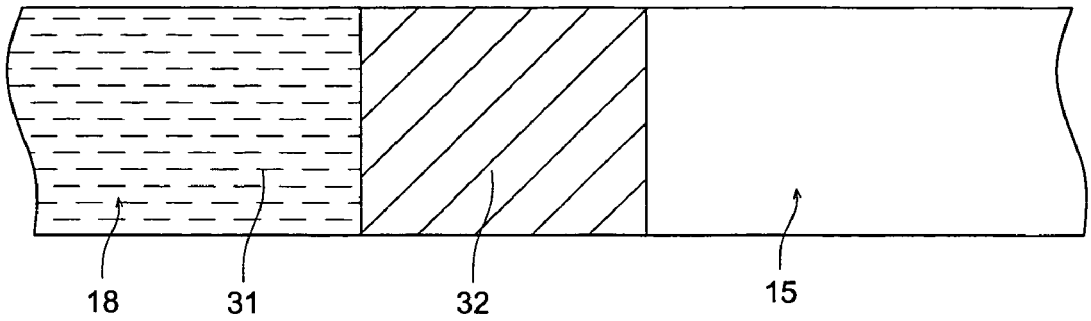
FIG. 3 shows the state in which sealing agent is loaded between the reagent storage section and the flow path communicating therewith.

It is preferable that the reagents are stored beforehand in the reagent storage sections such that the screening can be performed speedily without concern for time and place. The surface of the reagent storage section is sealed in order to prevent evaporation, mixing of air bubbles, contamination, and denaturing of the reagents which are incorporated into the chip. Furthermore, when the microreactor is stored, it is sealed by a sealing member to prevent the reagents to from leaking from the reagent storage section into the micro flow paths and causing a reaction. Prior to use, when the sealing agents are under refrigeration conditions in which μ-TAS (microreactor) is stored, they are in solid or gel form, and at the time of use, when it is under room temperature conditions, the sealing agents dissolve and are in a fluid state. As shown in FIG. 3, it is preferable that reagent in sealed in the reagent storage section by loading the sealing agent 32 between the reagent 31 and the flow path 15 which communicates with the reagent storage sections 18. It is to be noted that no problems will be caused even if there is air between the sealing agent and the reagent, but it is preferable that the amount of air there between (with respect to the amount of reagent) is sufficiently small.

A plastic material which has low solubility in water can be used as this type of sealing agent, and a fat whose solubility in water is 1% or less is preferably used. This type of fat can be checked in the Fat Handbook and the like, and examples thereof are given in Table 1.

In the case where the reagents are stored beforehand in the microreactor, it is preferable that the microreactor is kept refrigerated in view of stability of the reagent, and by using substance that is in a solid state when refrigerated and in a liquid state at room temperature as the sealing agent, the reagent is sealed by being in a solid state when refrigerated, and can easily become liquid and be discharged from the flow path at the time of use. Examples of this type of sealing agent include a fat which has a solubility of 1% or less in water and a melting point of 8° C. to room temperature (25° C.) and an aqueous solution of gelatin. The gelling temperature can be adjusted by changing the concentration of gelatin, and for example, in order to cause gelling at just before 10° C., a 10% aqueous solution should be used.

It is to be noted that the flow paths communicating with the storage sections for storing the positive controls and the negative controls may be loaded with sealing agent in a similar manner.

In this embodiment, a micro pump is connected at the upstream side of reagent storage sections, and reagent is pushed out into the flow path and fed by the drive fluid being supplied to the reagent storage section side by the micro pump.

TABLE 1

| Cmposition Name | Melting point (° C.) | |
|---|---|---|
| Pentadecane | 9.9 | |
| Tridecylbenzene | 10 | |
| Propyl phenyl ketone | 11 | |
| 1-Heptadecene | 11.2 | |
| Pentadecyl acetate | 11.4 | |
| Ethyl myristate | 12.3 | |
| Pelargonic acid | 12.5 | |
| 2-Methylundecanoic acid | 13 | |
| Caproic acid | 14 | 15 |
| Decane-2-one | 14 | |
| Ethyl pentadecanate | 14 | |
| 5-Methyltetradecanoic acid | 14.5 | 15 |
| 12-Tridecenol-1 | 15 | |
| 6-Methyltetradecanoic acid | 15 | 15.5 |
| Undecane-2-one | 15 | |
| 7-Methyltetradecanoic acid | 15.5 | 16 |
| Undecane-1-ol | 15.9 | |
| Didecyl ether | 16 | |
| Tetradecylbenzene | 16 | |
| Ethyl ricinoelaidate | 16 | |
| Pentadecyl caproate | 16.3 | |
| Heptyl phenyl ketone | 16.4 | |
| 10-Methyltetradecanoic acid | 16.5 | 17 |
| Monoheptyl phthalate | 16.5 | 17.5 |
| Caprylic acid | 16.7 | |
| Tridecane-2-ol | 17 | |
| Hexyl phenyl ketone | 17 | |
| 1-Octadecene | 17.6 | |
| 2-Heptylundecanoic acid | 18 | 19 |
| Corfn Cayani | 18 | 24 |
| Hexadecane | 18.2 | |
| Butyl palmitate | 18.3 | |
| 11-Methytetradecanoic acid | 18.5 | 19 |
| Hexadecyl acetate | 18.5 | |
| Methyl pentadecanate | 18.5 | |
| Methyl myristate | 18.5 | |
| Ethyl phenyl ketone | 19 | 20 |
| Amyl palmitate | 19.4 | |
| Methyl oleate | 19.9 | |
| Csrcal resin | 20 | 23 |
| Csm resin | 20 | 30 |
| Glycerin | 20 | |
| Dodecane-2-one | 20 | |
| Coconut oil | 20 | 28 |
| Propyl palmitate | 20.4 | |
| Methyl tridecanate | 20.5 | |
| Methyl phenyl ketone | 20.5 | |
| 11-Methyloctadecanoic acid | 21 | |
| Dodecyl laurate | 21 | |
| Monooctyl phthalate | 21.5 | 22.5 |
| Heptadecane | 21.9 | |
| Babassu oil | 22 | 26 |
| Pentadecylbenzene | 22 | |
| Methyldocosanoic | 22 | |
| acid Octyl palmitate | 22.5 | |
| Heptane-1,7-diol | 22.5 | |
| 2-Butyltetradecanoic acid | 23 | 24 |
| 1-Nonadecene | 23.4 | |

TABLE 1-continued

| Cmposition Name | Melting point (° C.) |
|---|---|
| Dodecane-1-ol | 24 |
| Heptadecyl acetate | 24.6 |

Pump Connection Portion

In this embodiment, the specimen storage section, the reagent storage section, the positive control storage section, and the negative control storage section respectively are provided with a micro pump for feeding the fluid contained therein to the storage sections. The micro pump is incorporated into a main body device which is separate from the microreactor, and by attaching the microreactor to the device main body, the microreactor is connected from the pump connection portion.

In this embodiment, a piezo pump is used as the micro pump. FIG. 4 (*a*) is a cross-sectional view of an example of this pump and FIG. 4 (*b*) is a top view thereof. The micro pump comprises: a first fluid chamber 48, a first flow path 46, a pressure chamber 45, a second flow path 47, and a substrate 42 formed by the second fluid chamber 49, an upper substrate 41 which is formed as a layer on the substrate 42, and a vibration plate 43 which is formed as a layer on the upper substrate 41, a pressure chamber 45 of the vibration plate 45, a piezoelectric element 44 which is formed as a layer on the side opposite to the pressure chamber side of the vibration plate 43, and a drive portion (not shown) for driving the piezoelectric element 44.

In this example, a light-sensitive glass substrate having a thickness of 500 μm is used as the substrate 42, and by performing etching until a depth of 100 μm is reached, the fluid chamber 48, the first flow path 46, the pressure chamber 45, the second flow path 47, and the second fluid chamber 49 are formed. The width of the first flow path 46 is 25 μm and the length is 20 μm. The width of the second flow path 47 is 25 μm and the length is 150 μm.

The upper surface of the first fluid chamber 48, the first flow path 46, the second fluid chamber 49, and the second flow path 47 are formed by the upper substrate 41 which is a glass substrate being formed as a layer on the substrate 42. The portion which contacts the upper surface of the pressure chamber of the upper substrate 41 is processed by etching and the like and thereby penetrated.

A thin vibration plate formed from thin glass having a thickness of 50 μm is formed as a layer on the upper surface of the upper substrate 41 and a piezoelectric element 44 formed from lead titanate zirconate (PZT) ceramics of a thickness of 50 μm, for example, is formed as a layer thereon.

The piezoelectric element 44 and the vibration plate 43 adhered thereto are vibrated by the drive voltage from the driving section, and the capacity of the pressure chamber 45 is thereby increased and decreased. The width and depth of the first flow path 46 and the second flow path 47 are the same, and the length of the second flow path is greater than that of the first flow path, and if the pressure difference in the first flow path 46 is large, turbulence such that of whirlwind is generated and the flow path resistance increases. On the other hand, because the second flow path 47 is a long flow path, even if the pressure difference is large, laminar flow is facilitated and the change ratio of the flow path resistance with respect to the change in the pressure difference is smaller than for the first flow path.

For example, due to the drive voltage for the piezoelectric element 44, the vibration plate 43 is quickly displaced in the inner direction of the pressure chamber 45, and the capacity of the pressure chamber is 45 is reduced while a large pressure difference is being applied, and next the vibration plate 43 is slowly displaced to the outer direction from the pressure chamber 45 and the capacity of the pressure chamber 45 is increased while a small pressure difference is being applied and the fluid is fed in direction B in the drawing. Conversely, the vibration plate 43 is quickly displaced in the outer direction of the pressure chamber 45, and the capacity of the pressure chamber 45 is increased while a large pressure difference is being applied, and next the vibration plate 43 is slowly displaced to the inner direction from the pressure chamber 45 and the capacity of the pressure chamber 45 is reduced while a small pressure difference is being applied and the fluid is fed in direction A in the drawing. FIG. 5 shows an example of the relationship between the drive voltage waveform which is applied to the piezoelectric element 44 and the position displacement of the fluid. The graph of fluid migration quantity shown in FIG. 5 (*b*) is a pattern graph of the flow quantity obtained by operation of the pump, and shows behavior when time delay or inert vibrations due to inertial force of the fluid are weighed. It is to be noted that difference in the change ratio of the flow path resistance with respect to the change in pressure difference in the first flow path and second flow path is not necessarily due to the difference in the length of the flow paths and may be based on other configuration differences.

In the piezo pump configured as described above, by changing the drive voltage and frequency of the pump, the feed direction and feeding speed of the fluid can be controlled. FIG. 4 (*c*) shows another example of the pump. In this example, the pump comprises a silicon substrate 71, a piezoelectric element 44, and a flexible wire that is not shown. The silicone substrate 71 is a silicon wafer which has been processed to have a prescribed shape by known photolithography techniques, and the pressure chamber 45, the diaphragm 43, the first flow path 46, the first fluid chamber 48, the second flow path 47 and the second fluid chamber 49 are formed by etching. The first fluid chamber 48 has a port 72 while the second fluid chamber 49 has a port 73 and the fluid chambers communicate with the pump connection portion of the microreactor via these ports. For example, the pump can be connected to the microreactor by vertically superposing the substrate 74 into which the port is formed and the vicinity of the pump connection portion of the microreactor. Also, a plurality of pumps may be formed on a single silicon substrate. In this case, the port at the opposite side of the port that is connected to the microreactor preferably has a drive fluid tank connected thereto. In the case where there is a plurality of tanks, their ports may be connected in common to the drive fluid tank.

Figure 6:
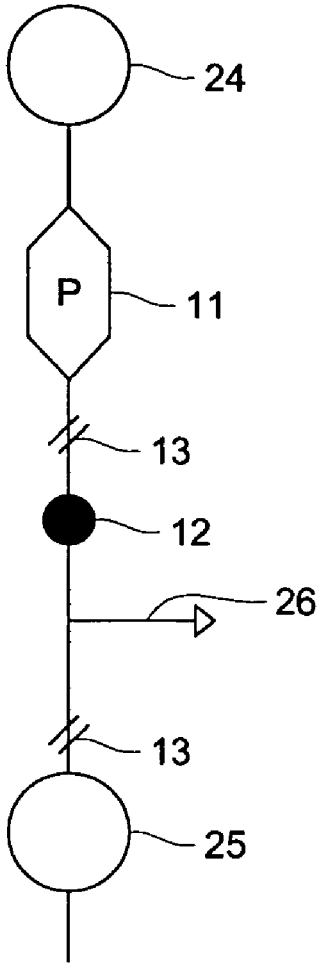
FIG. 6 (*a*) shows the structure of the pump portion for feeding the drive fluid and FIG. 6 (*b*) shows the structure of the pump portion for feeding the reagent.
Figure 6:
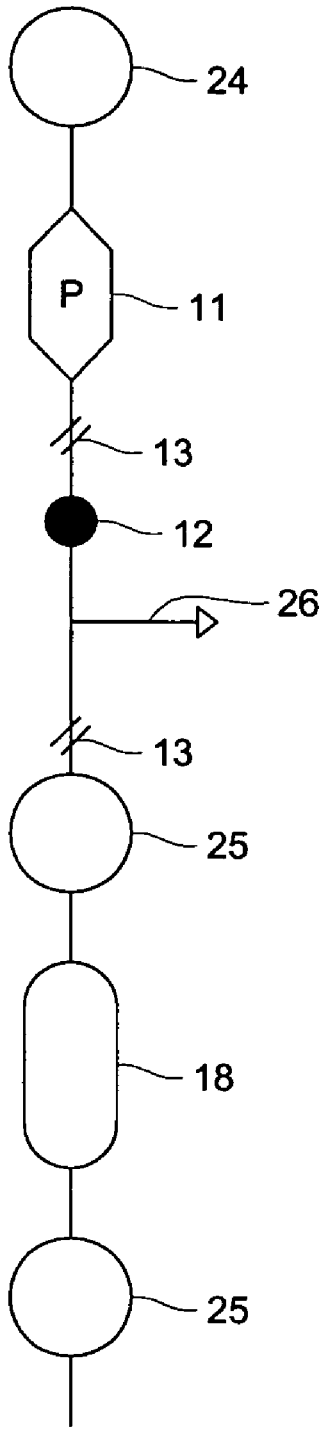
Figure 7:
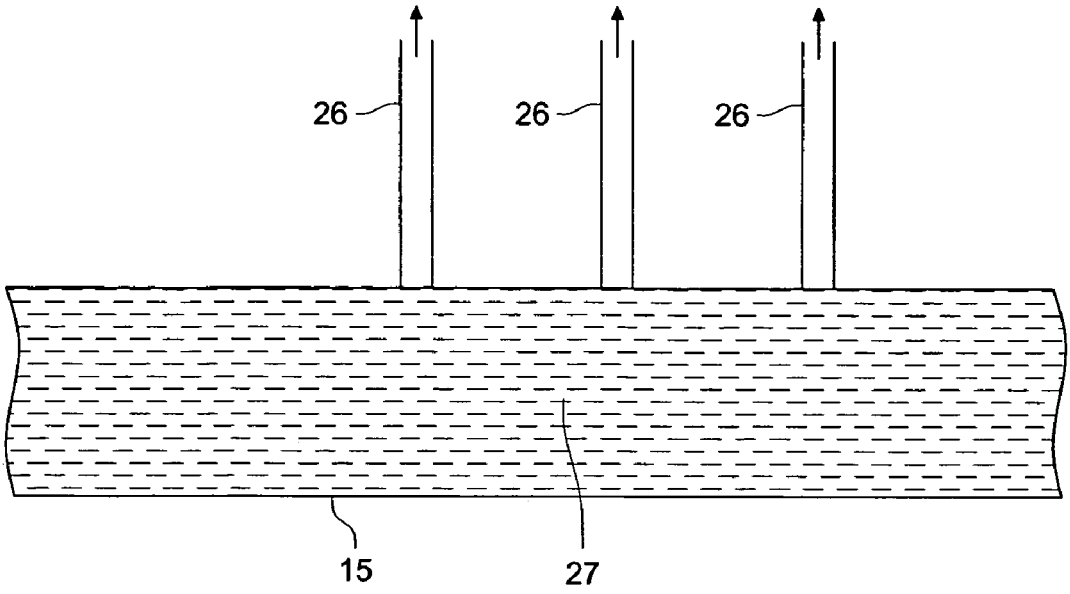
FIG. 7 shows the air vent flow path.

The structure of the pump connection portion area is shown in FIG. 6. FIG. 6 (*a*) shows the structure of the pump portion for feeding the drive fluid and FIG. 6 (*b*) shows the structure of the pump portion for feeding the reagent. The drive fluid 24 herein may be an oil based substance such as mineral oil or a water based substance and the sealing fluid which seals the reagent may be loaded in the flow path as shown in FIG. 3 or may be loaded in a reservoir section for the sealing fluid. The flow path between the pump connection portion 12 and the reagent storage section 18 has an air vent flow path 26. As shown in FIG. 7, the air vent flow path branches from the flow path 15 between the pump connection portion and the reagent storage section and the end thereof is open. When the pump is connected for example, air bubbles present in the flow path 15 are removed through the air vent flow path 26.

The diameter of the air vent flow path 26 is preferably no greater than 10 μm in view of preventing leakage of water and other aqueous fluids, for example that pass through the flow path 15 and it is also preferable that the contact angle of the inner surface of the flow path with water is not less than 30°.

Figure 8:
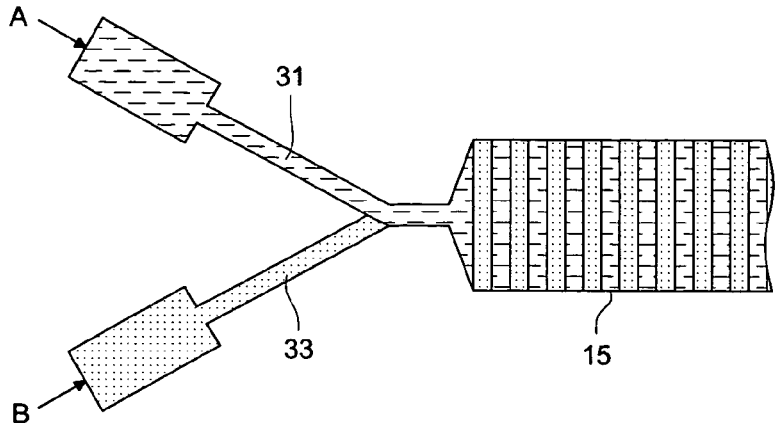
FIGS. 8 (*a*) and (*b*) show the mixture of the specimen and the reagent in the flow path by being fed from above the Y-shaped flow path and FIG. 8 (*c*) is graph showing the driving of the feed pump.
Figure 8:
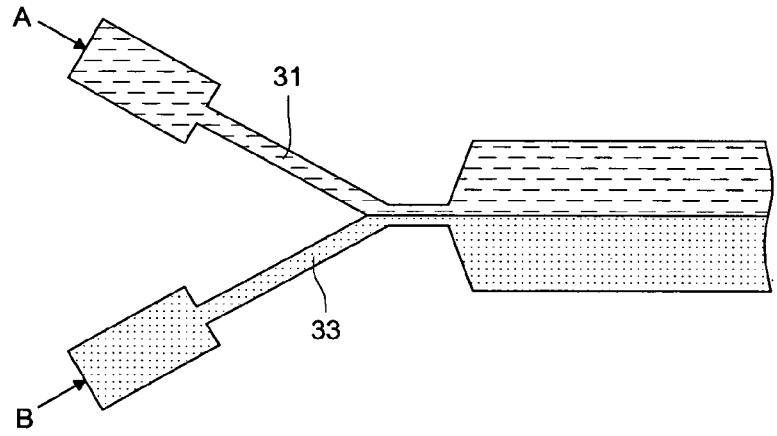
Figure 8:
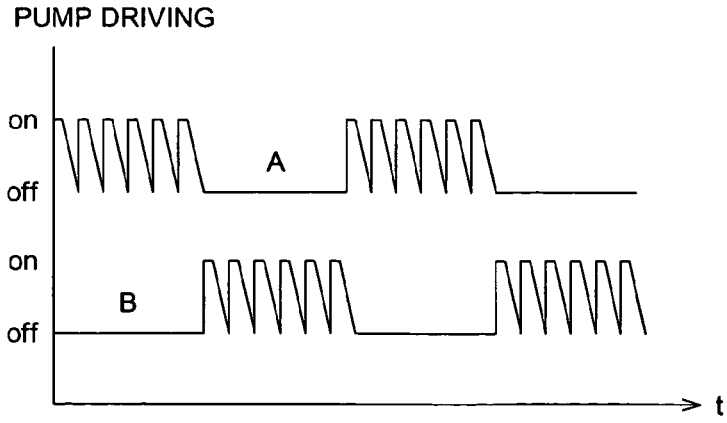

In order to speedily mix reagent and reagent or specimen and reagent in the micro flow path, the driving of the micro pumps for feeding these substances is controlled as described in the following. As shown in FIG. 8 (*a*), in the case where the reagent is fed in the A direction from upstream of the Y-shaped flow path and the specimen 33 is sent in the B direction, and as a result, they are mixed in the flow path 15, driving of the pump which feeds the reagent 31 and the pump which feeds the specimen 33 are controlled as shown in FIG. 8 (*c*). In other words, while the reagent 31 is fed in the A direction, feeding of the specimen 33 is stopped, and while specimen 33 is being fed in the B direction, feeding of the reagent 31 is stopped. By alternately repeating these operations, as shown in FIG. 8 (*a*), the reagent 31 and the specimen 33 are alternately fed into the flow path 15 in a sectional state. By increasing the switching speed of the pump feeding, the width of the section layer may, for example be 1 to 2 μm. The shorter the width of the layer, the faster the dispersion between the reagent 31 and the specimen 33 and they are thereby mixed. For example, in the case where the reagent 31 and the specimen 33 in having a diameter of 100 μm are fed into the flow path 15 at a fixed proportion of 1:1, as shown in FIG. 8 (*b*), a reagent layer and a specimen layer having a width of approximately 50 μm are formed and when compared to the case of FIG. 8 (*a*), it is difficult for dispersion to progress and mixing is delayed.

In this manner, when each of the fluids is fed into the mixing flow path from the plurality of branched flow paths, by switching the flow speed for each of the branched flow paths, mixing can be done quickly and the fluid can be mixed at a desired ratio. It is to be noted that although it has been stated that mixing can be done quickly in FIG. 8 (*a*), if the flow path width is reduced or more time is used, mixing can be done in the system of FIG. 8 (*b*).

Feed Control Section

A plurality of feed control sections are provided in the flow path of the microreactor of this embodiment as shown in FIG. 9 (*a*). The feed control section interrupts the passage of fluid pressure in the normal direction until a prescribed pressure is reached, and passage of the fluid is permitted when a pressure not less than the prescribed pressure is applied.

As shown in FIGS. 9 (*a*) and (*b*), the feed control section 13 is formed of a contracted diameter portion of the flow path, and due to this portion, the passage from the other end of fluid reaching the contracted flow path (micro flow path) 51 from one end side is regulated. The contracted flow path 51 is formed, for example with a length and width of about 30 μm×30 μm in contrast to flow path with length and width of 150 μm×150 μm and both sides are linearly connected.

In order to push out the fluid from the end 51*a* of the minute contracted diameter flow path 51 to the large diameter flow path 15, a prescribed feed pressure is required for surface tension. Accordingly, because stopping and flowing of the fluid can be controlled by the pump pressure from the micro pump, migration of the fluid at a prescribed location in the flow path can be temporarily stopped for example, and feeding from this prescribed location to the flow path ahead can be resumed at a prescribed timing.

If necessary, a water repelling coating such as a fluorine based coating may be provided at the inner surface of the contracted flow path 51.

By providing this type of feed control portion which is formed between these flow paths such that flow paths adjacent to both sides are linearly connected and comprise micro flow paths having a cross-sectional capacity which is smaller than the cross-sectional capacity due to the cross-section which is perpendicular to the flow path axial direction in these adjacent flow paths, the feed timing can be controlled.

Reverse Flow Prevention Section

The microreactor of this embodiment includes a plurality of reverse flow prevention sections for preventing reverse flow of the fluid in the flow paths. The reverse flow prevention section has a check valve in which the flow path opening is closed by a valve element due to reverse flow pressure, or an active valve in which a valve element is pressed onto the flow path opening portion by a valve element deforming means to close the opening.

Figure 10:
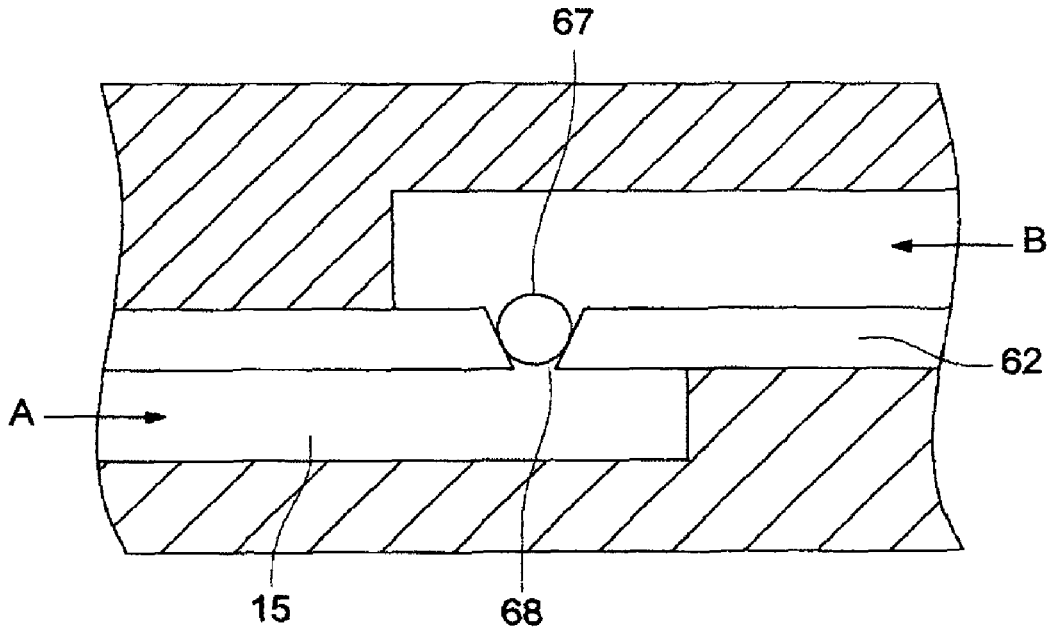
FIGS. 10 (*a*) and (*b*) are cross-sectional views showing an example of the check valve provided in the flow path.
Figure 10:
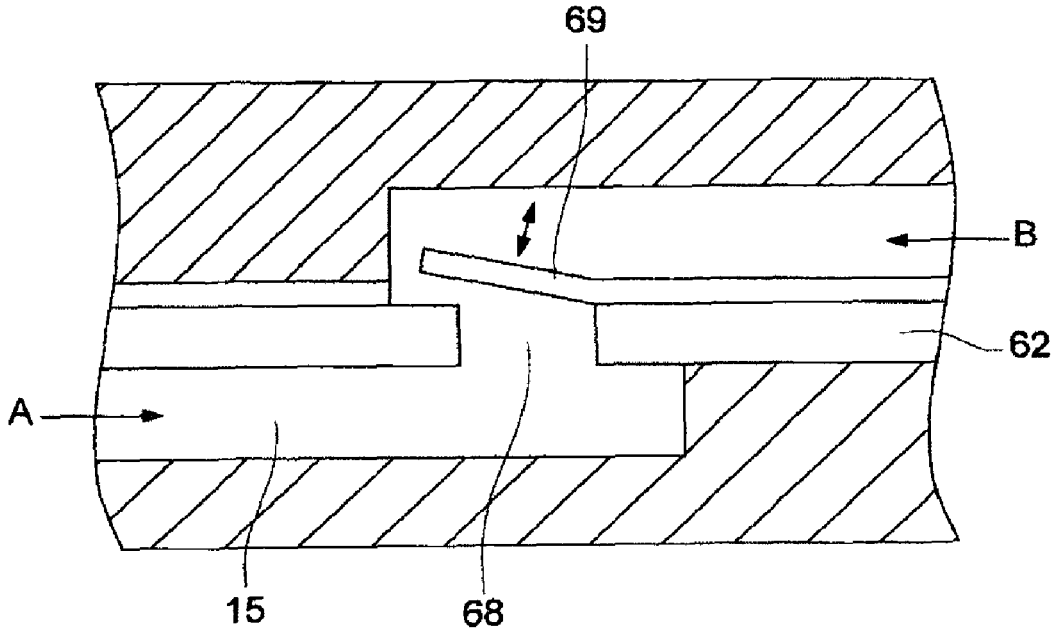

FIGS. 10 (*a*) and (*b*) are cross-sectional views showing an example of the check valve used in the flow path of the microreactor of this embodiment. The check valve in FIG. 10 (*a*) has a microsphere 67 as a valve element and by opening and closing the opening 68 formed in the substrate 62 due to migration of the microsphere 67, the passage of fluid is permitted or interrupted. In other words, when the fluid is fed from the A direction, the microsphere 67 separates from substrate 62 due to the fluid pressure and the opening 68 is opened and thus the flow of fluid is permitted. On the other hand, in the case where the fluid is fed from the B direction, the microsphere 67 sits on the substrate 62 and the opening 68 is closed, and thus the flow of fluid is interrupted.

The check valve in FIG. 10 (*b*) is formed as a layer on the substrate 62 and the plastic substrate 69 whose end has play above the opening 68 opens and closes the opening 68 due to upward and downward movement above the opening 68 due to fluid pressure. In other words, when the fluid is fed from the A direction, the end of the plastic substrate 69 separates from substrate 62 due to the fluid pressure and the opening 68 is released and thus the flow of fluid is permitted. On the other hand, in the case where the fluid is fed from the B direction, the plastic substrate 69 sits on the substrate 62 and the opening 68 is closed, and thus the flow of fluid is interrupted.

Figure 11:
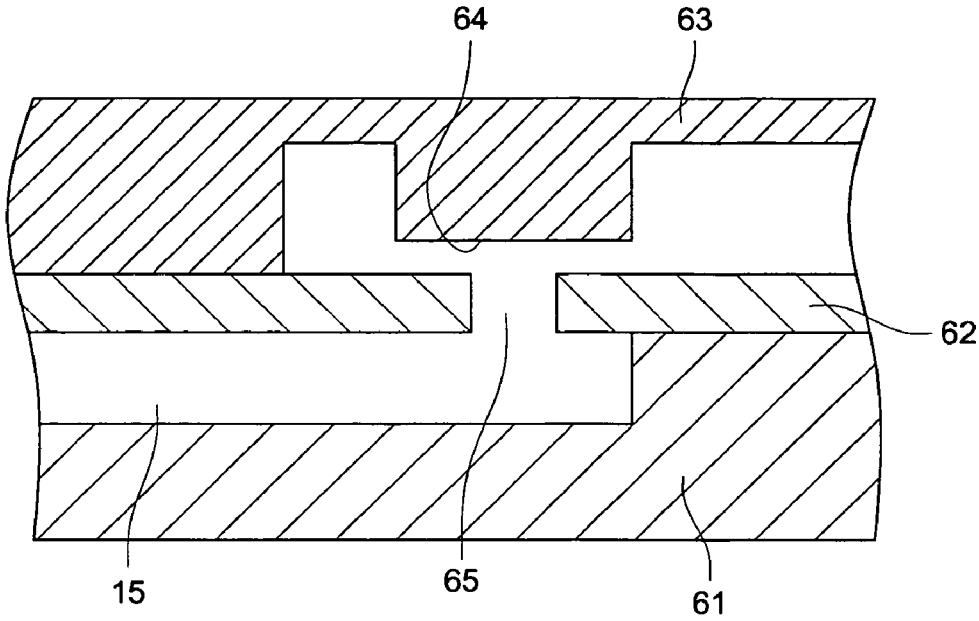
FIG. 11 is a cross-sectional view showing an example of the active valve provided in the flow path and FIG. 11 (*a*) shows the open state while FIG. 11 (*b*) shows the closed state.
Figure 11:
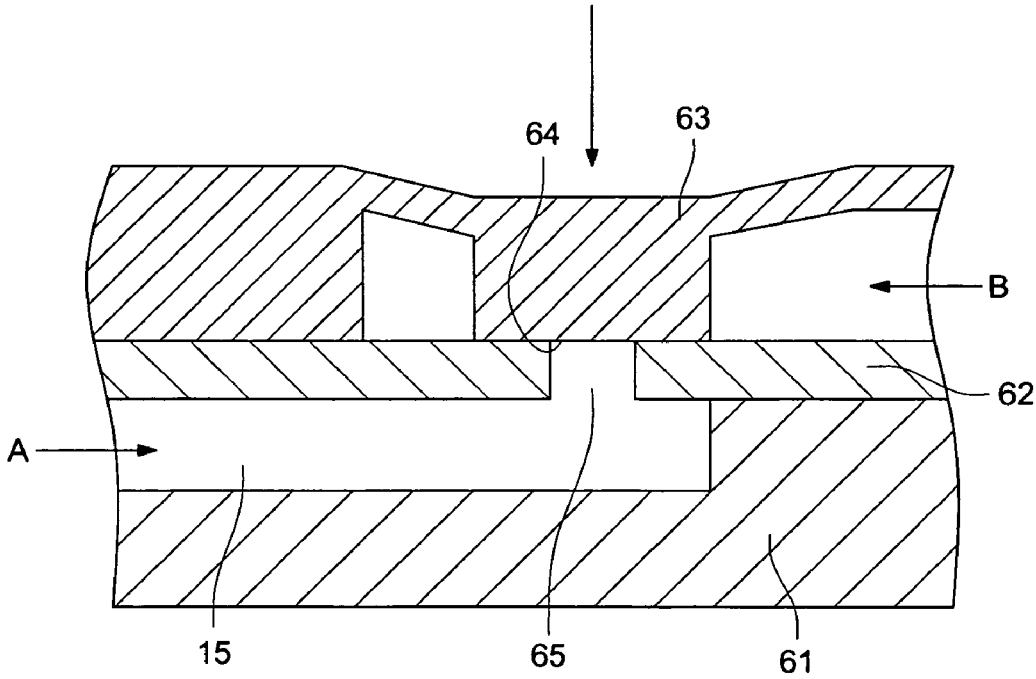

FIG. 11 is a cross-sectional view of showing an example of the active valve used in the flow path of the microreactor of this embodiment, and FIG. 11 (*a*) shows the valve in an open state while FIG. 11 (*b*) shows the valve in closed state. In this active valve, the plastic substrate 63 which has a valve portion 64 that protrudes downward is formed as a layer on top of substrate 62 in which the opening 65 is formed.

As shown in FIG. (b) when the valve is closed, the valve portion 64 adheres to the substrate 62 so as to cover the opening by pressing a valve deforming means such as an air pressure piston, an oil pressure piston or a water pressure piston or a piezoelectric actuator, or a shape memory alloy actuator, and reverse flow in the B direction is thereby prevented. In addition the operation of the active valve is not limited to an external driving device, and the valve itself may deform to close the flow path. For example, as shown in FIG. 18, the bimetal 81 may be used and deformation may be done by electrical heating, or alternatively, as shown in FIG. 19, deformation may be done by heating using a shape memory alloy 82.

Reagent Assay Section

Figure 12:
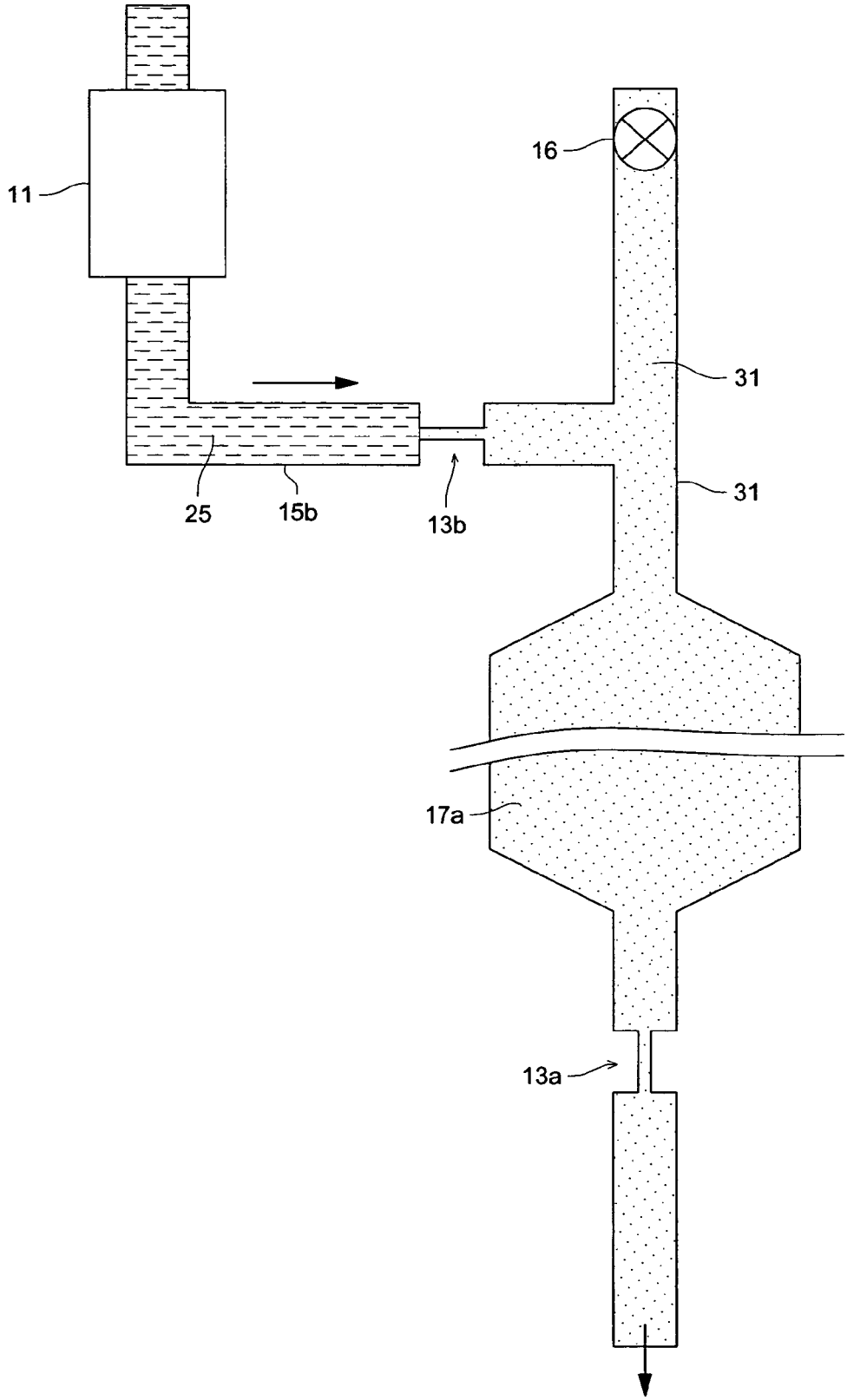
FIG. 12 shows the structure of this type reagent assay section.

Quantitative feeding of the reagent can be done using the feed control section and the reverse flow portion. FIG. 12 shows the structure of this type reagent assay section, and the feed path (reagent loading flow path 15*a*) between the reverse flow portion 16 and the feed control section 13*a* is loaded with a prescribed quantity of reagent. In addition, the reagent loading flow path 15*a* is provided with a branched flow 15*a* path which branches therefrom and communicates with the micro pump 11 which feeds the drive fluid.

Feeding of fixed quantities of the reagent is performed as follows. First, the reagent 31 is loaded by being supplied to the reagent loading flow path 15*a* using a feed pressure that does not allow the reagent 31 to pass forward from the feed control portion 13*a* from the reverse flow portion 16 side. Next, by feeding the drive fluid 25 in the direction of the reagent loading flow path 15*a* from the branched flow path 15*b* using the micro pump 11 with the feed pressure that allows the reagent 31 to pass forward from the feed control portion 13*a*, the reagent 31 that has been loaded in the reagent loading flow path 15*a* is pushed forward from the reagent loading flow path 15*a*, and as a result a fixed quantity of the reagent 31 is fed. The branched flow path 15*b* sometimes has air or sealing fluid present therein, but even in this case, the drive fluid 25 is fed by the micro pump 11, and the air, the sealing fluid and the like are sent into the reagent loading flow path 15*a* to thereby push out the reagent. It is to be noted that by providing a large capacity reservoir section 17*a* in the reagent loading flow path 15*a*, variation in the fixed volume is reduced.

Reagent Mixing

Figure 13:
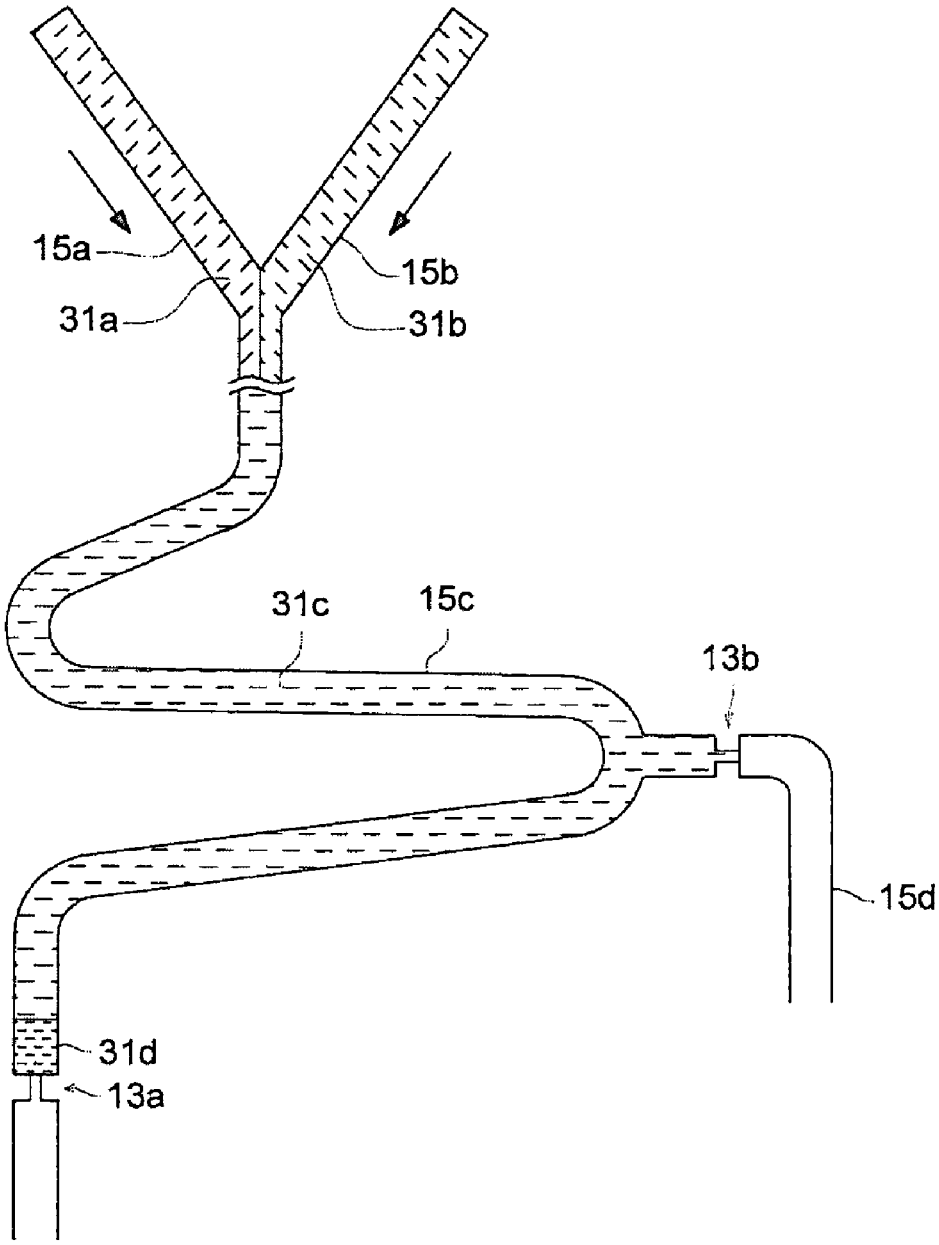
FIG. 13 shows the flow path structure in which the front portion is discarded and the mixture is fed to the next step after the mixing ratio has been stabilized.

In the case where 2 reagents are mixed by the Y-shaped flow path, even if both reagents are fed simultaneously, the mixing ratio for the front portion of the fluid is not stable. FIG. 13 shows the flow path structure in which the front portion is discarded and the mixture is fed to the next step after the mixing ratio has been stabilized. In FIG. 13, the reagents 31*a* and 31*b* which are mixed are fed from the flow paths 15*a* and 15*b* respectively to the mixing flow paths 15*c*.

The branched path 15*d* which feeds the reagent mixture 31*c* from the mixing flow path 15*c* to the next step is branched, and a first feed control section 13*a* is provided at a position beyond the branching point of the branched flow path 15*d* in the mixing flow path 15*c*. A second feed control section 13*b* is provided at a position in the vicinity of the branching point of the mixing flow path 15*c* in the branched flow path 15*d* and the feed pressure which allows the reagent mixture 31*c* to pass is smaller than that of the first feed control section 13*a*.

The reagent mixture 31*c* of reagent 31*a* and reagent 31*b* which were fed from the flow path 15*a* and the flow path 15*b* to the mixing path 15*c* is fed into the mixing path 15*c* until the front end portion 31*d* of the reagent mixture 31*c* reaches the first feed control section 31*a*. After the front end portion 31*d* of the reagent mixture 31*c* reaches the first feed control section 31*a*, by further feeding into 15*c*, the reagent mixture 31*c* is passed from the second feed control section 13*b* to the branched flow path 15*d*, and then the reagent mixture 31*c* is fed to the next step.

For example, because the cross-sectional area of the micro flow paths in the first feed control section is smaller than the cross-sectional area of the micro flow paths in the second feed control section, the feeding pressure which allows passage of the reagent mixture 31*c* in the second feed control section 13*b* can be made smaller than that of the first feed control section 13*a*.

The following is a description of specific examples of the gene amplification reaction and detection thereof used in the micro reactor of this embodiment which includes each of the above-described structural elements, with reference to FIGS. 14 to 17. A reagent including a biotin modified chimera primer for specific hybridization of the gene to be detected, a DNA polymerase having strand activity, and an endonuclease are stored in the reagent storage sections 18*a*, 18*b* and 18*c* in FIG. 14 and a piezo pumps 11 which are built into the main body device which is separate from the microreactor are connected at the upstream side of each of the reagent storage portions using the pump connection portion 12, and reagent is fed from each of the reagent storage sections to path 15*a* at the downstream side, by these pumps.

The flow path 15*a*, the flow paths to the next step which are branched from flow path 15*a*, and the feed control sections 13*a* and 13*b* form the flow path illustrated in FIG. 13, and the front portion of the mixture of reagents fed from the reagent storage section is discarded and the mixture is fed to the next step after the mixing ratio has been stabilized. A total of over 7.5 μl of reagent is stored in each of the reagent storage sections and of the total of 7.5 μl of reagent mixture, 2.5 μl each of the discarded front end portion is sent to the 3 branched flow paths 15*b*, 15*c* and 15*d*. The flow path 15*b* communicates with reaction and detection system for the specimen (FIG. 15), the flow path 15*c* communicates with reaction and detection system for the positive control (FIG. 16), and the flow path 15*d* communicates with reaction and detection system for the negative control (FIG. 17).

Figure 15:
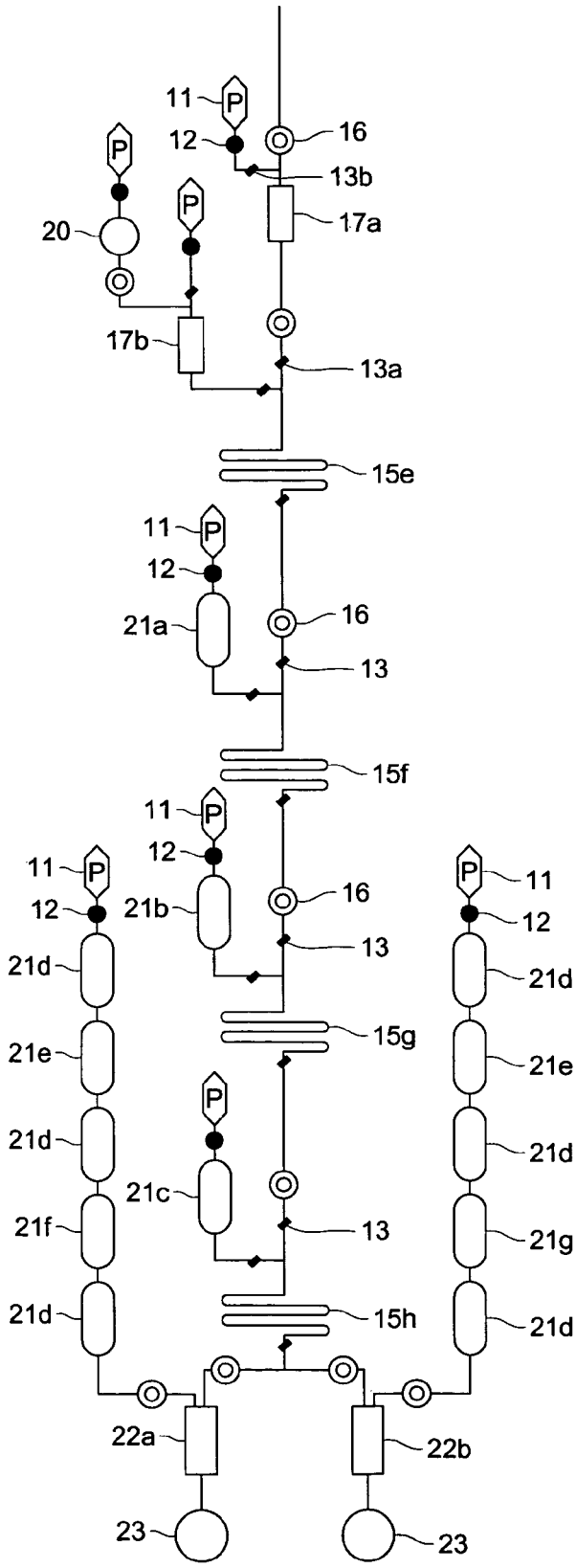
FIG. 15 shows the structure of the portion which communicates with the flow paths in FIG. 14 and performs the amplification reaction of the specimen and the reagents and detection thereof.

The mixed reagents that have been fed to the flow path 15*b* loaded the reservoir section 17 in FIG. 15. It is to be noted that the reagent loading path illustrated in FIG. 12 is formed between the check valve 16 at the upstream side of the reservoir section 17 and the feed control section 13*a* at the downstream side, and it forms the above-described reagent assay section along with the feed control section 13*b* provided in the branched flow path which communicates with the pump 11 which feeds drive fluid.

A specimen extracted from blood or sputum is poured from the specimen storage section 20 and the specimen is loaded in the reservoir section 17 in a fixed quantity (2.5 μl) using the same structure as the reagent assay section, and fed in a fixed quantity to connected flow path. The specimen and reagent mixture that are loaded in the reservoir sections 17 are fed to the Y-shaped flow path via the flow path 15*e* (volume 5 μl) and mixing and ICAN reaction are performed in the flow path 15*e*. As illustrated in FIG. 8, the feeding of the specimen and the reagent is done by alternately driving each of the pumps 11 and alternately introducing specimen and reagent mixture in sections to the flow path 15*e* and the specimen and the reagents are quickly dispersed and mixed.

The amplification reaction is stopped by feeding 5 μl of reaction solution and 1 μl of reaction stopping solution stored in the stopping solution storage section 21*a* into the flow path 15*f* which has a capacity of 6 μl and mixing them. Next, the denaturant (1 μl) stored in the denaturant storage section 21*b* and a mixture (0.5 μl) of the reaction solution and the stopping solution are fed to the flow path 15*g* having a capacity of 1.5 μl and mixed and one strand of the amplified gene is denatured.

Next probe DNA solution (2.5 μl) that is stored in the probe DNA storage section 21*c* and whose end has been subjected to fluorescent marking with FITC (fluorescein isothiocyanate) and processing solution (1.5 μl) which has undergone denaturing processing are fed into the flow path 15*h* having a capacity of 4 μl and mixed and the probe DNA is hybridized with one gene strand.

Next, the 2 μl of processing solution is fed to each of the streptavidin adsorbing sections 22*a* and 22*b* in which streptavidin has been adsorbed in the flow path, and the amplified gene that has been marked with the probe is fixed in the flow path.

The rinsing solution, the internal control probe DNA solution, and the gold colloid solution marked with the FITC antibody stored in each of the storage sections 21*d*, 21*f*, and 21*e* are fed in the order shown in the figure, inside the flow path 22*a* in which the amplified gene is fixed, by a single pump 11. Similarly, the rinsing solution, the MTB probe DNA solution and the gold colloid solution marked with the FITC antibody stored in each of the storage sections 21*d*, 21*g*, and 21*e* are fed in the order shown in the figure, inside the flow path 22*b* in which the amplified gene is fixed, by a single pump 11.

The gold colloid is bound to the fixed amplified gene via the FITC by feeding the gold colloid solution and is thereby fixed. By optically detecting the fixed gold colloid a determination is made as to whether there was amplification or the efficiency of amplification is measured.

Figure 14:
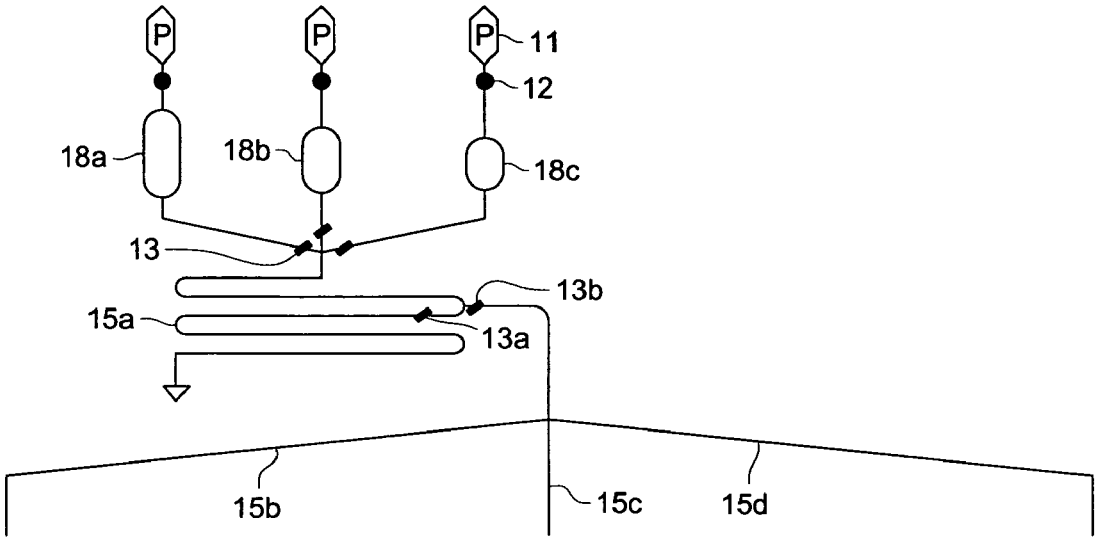
FIG. 14 shows the structure of the reagent mixing portion of the microreactor in an embodiment of this invention.
Figure 16:
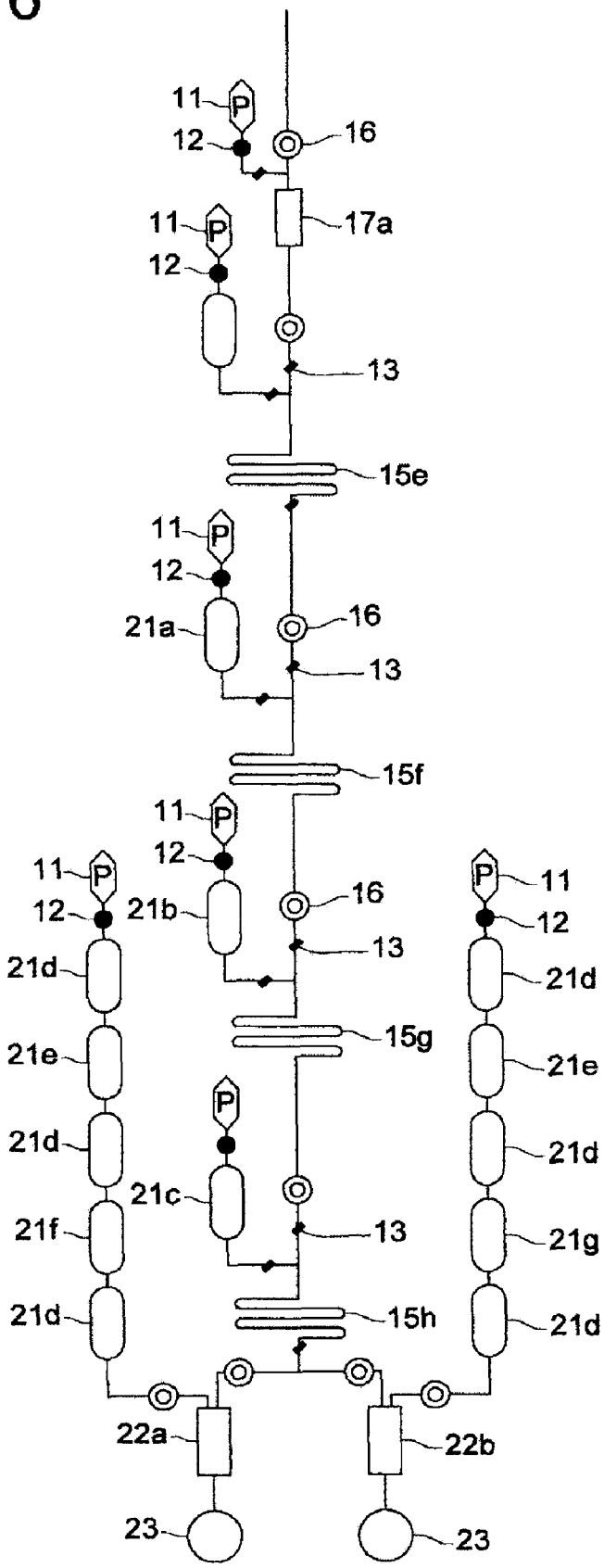
FIG. 16 shows the structure of the portion which communicates with the flow paths in FIG. 14 and performs the amplification reaction of the positive control and the reagents and detection thereof.
Figure 17:
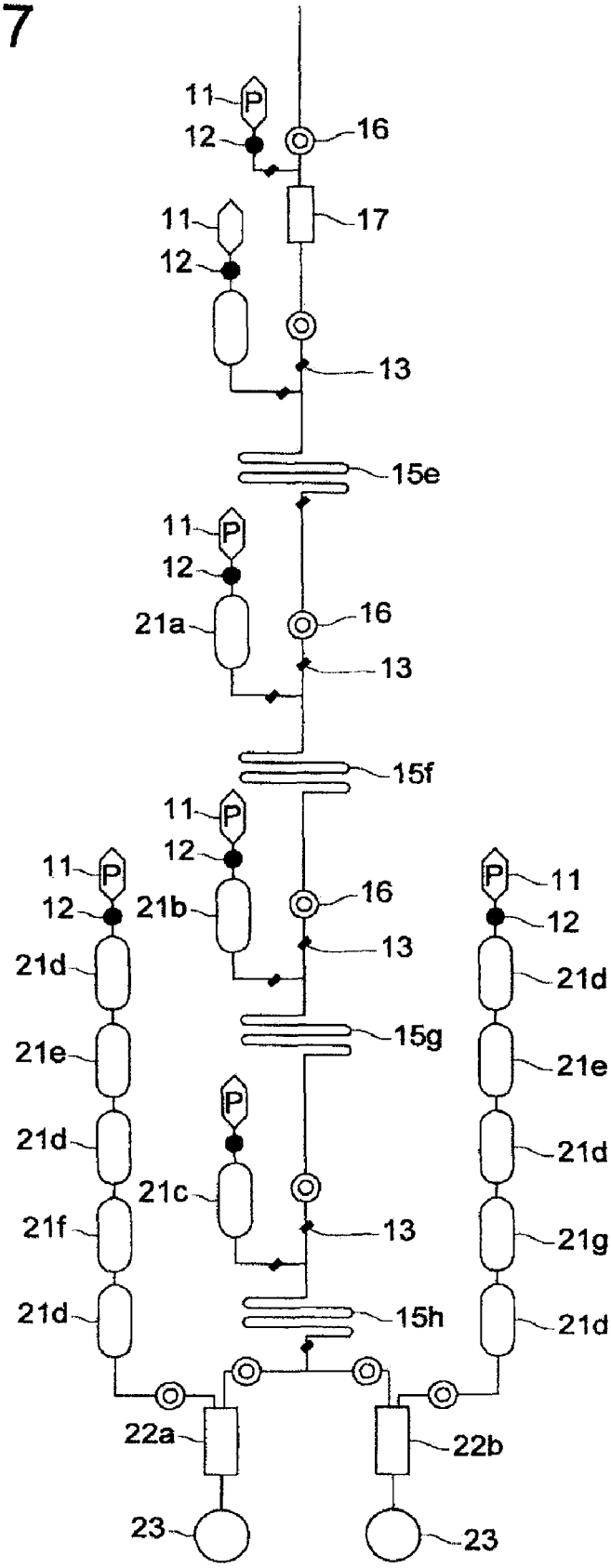
FIG. 17 shows the structure of the portion which communicates with the flow paths in FIG. 14 and performs the amplification reaction of the negative control and the reagents and detection thereof.

The flow paths 15*c* and 15*d* in FIG. 14 communicate with the positive control reaction and detection system shown in FIG. 16 and the negative control reaction and detection system shown in FIG. 17 respectively and by feeding the reagent mixtures thereto, as in the case of the above-described specimen reaction and detection system, after the amplification reaction is performed with the reagent in the flow path, hybridization is performed with the probe DNA stored in the probe DNA storage section in the flow path, and amplification reaction detection is done based on reaction products.

What is claimed is:

1. A micro-reactor for analyzing a sample, comprising:

(1) a plate-shaped chip;

(2) a plurality of reagent storage sections each having a chamber to store a reagent and a flow path through which a flow of the reagent is fed from the chamber;

(3) a reagent mixing section to mix plural flows of reagents fed through respective flow paths from the plurality of reagent storage sections so as to produce a flow of mixed reagent;

(4) a sample receiving section having an injection port through which a sample is injected from outside; and (5) a reacting section to mix and react the mixed reagent fed from the reagent mixing section and the sample fed from the sample receiving section;

wherein the plurality of reagent storage sections, the reagent mixing section, the sample receiving section and the reacting section are incorporated in the chip and are connected through flow paths, and wherein the reagent mixing section comprises a mixing flow path in which the plural flows of reagents are mixed, and a feed-out flow path to feed out the flow of mixed reagent to the reacting section, and wherein the feed-out flow path is branched from a middle point of the mixing flow path so that a portion of the mixing flow path between the middle point and a downstream end of the mixing flow path forms a discarding portion into which the leading portion of the flow of mixed reagent is discarded without being fed out to the reacting section.

2. The micro-reactor of claim 1, wherein the reagent mixing section further comprises a feed-out control section provided at the middle point of the mixing flow path so as to connect the mixing flow path and the feed-out flow path, and wherein the feed-out control section allows the flow of mixed reagent to pass from the mixing flow path to the feed-out flow path when an inner pressure in the mixing flow path becomes higher than a predetermined pressure.

3. The micro-reactor of claim 2, wherein the feed-out control section includes a thin flow path having a cross-sectional area smaller than that of the feed-out flow path.

4. The micro-reactor of claim 1, wherein each of the plurality of reagent storage sections has an injecting port through which a driving liquid is injected in the chamber and an exit port through which a stored reagent is extruded from the chamber by the injected driving liquid.

5. The micro-reactor of claim 4, wherein the injecting port is jointed with a pump connecting section capable of connecting with an external pump so that the driving liquid is injected in the chamber through the injecting port by the external pump.

6. The micro-reactor of claim 5, wherein an air vent path having an open end is provide on a joint section between the pump connecting section and the injecting port.

7. The micro-reactor of claim 6, wherein the air vent path has a diameter of 10 μm or less and a contact angle of 30° or more with water.

8. The micro-reactor of claim 6, wherein the exit port of the reagent storage section is filled with a sealing member to prevent the stored reagent from leaking from the chamber.

9. The micro-reactor of claim 8, wherein the sealing member is a solid state under a cooled temperature below room temperature and a liquid or fluid state at or above room temperature.

10. The micro-reactor of claim 8, wherein the sealing member has a melting point of 8° C. to 25° C.

11. The micro-reactor of claim 8, wherein the sealing member is a fatty oil or an aqueous solution of gelatin.

12. The micro-reactor of claim 1, further comprising:

a mixed reagent filling section provided between the reagent mixing section and the reacting section, to fill the mixed reagent fed from the reagent mixing section and to feed out a predetermined amount of the mixed reagent necessary for reaction to the reacting section.

13. The micro-reactor of claim 12, wherein the mixed reagent filling section comprises a filling flow path to fill the mixed reagent, a reverse flow preventing section provided at an entrance of the filling flow path, a liquid feed-out control section provided at an exit of the filling flow path, and branch flow path jointed with a portion of the filling flow path at a position near the entrance, and wherein the branch flow path is jointed to a pump connecting section capable of connecting with an external pump, and after the filling flow path is filled with the mixed reagent, the external pump feed a driving liquid though the branch flow path in the filling flow path so as to increase an inner pressure in the filling flow path so that the mixed reagent is fed out from the liquid feed-out control section.

14. The micro-reactor of claim 13, wherein the reverse flow preventing section is a check valve in which a valve element closes the opening of the flow path using reverse flow pressure or an active valve in which a valve element is pressed onto the flow path opening portion by a valve element deforming means to close the opening.

15. The micro-reactor of claim 1, wherein the micro-reactor is a gene testing micro-reactor.

16. The micro-reactor of claim 15, wherein the plurality of reagent storage sections store reagents used in a gene amplification reaction.

17. The micro-reactor of claim 16, further comprising:

a positive control storage section into which the positive control is stored;

a negative control storage section into which the negative control is stored; and a probe DNA storage section into which the probe DNA for hybridization with the gene for detection that has been amplified by a gene amplification reaction is stored.

18. The micro-reactor of claim 17, wherein after a micro pump is connected to chip via a connection portion, and the specimen or the DNA extracted from the specimen stored in the specimen storage section and the reagent stored in the reagent storing section are fed to the mixing flow path and then mixed in the mixing flow path to cause an amplification reaction, the processing fluid resulting from processing the reaction fluid and the probe DNA stored in the probe DNA storage section are fed, and mixed and hybridized in the flow path, and the amplification reaction detection is performed based on the reaction products, and similarly, the positive control stored in the positive control storage section and the negative control stored in the negative control storage section undergo amplification reaction with the reagent stored in the reagent storage section in the flow path, and then hybridization with the probe DNA stored in the probe DNA storage section in the flow path and amplification reaction detection is performed based on the reaction products.

19. The micro-reactor of claim 15, further comprising:

a reverse transcription enzyme storage section into which the specimen or RNA extracted from the specimen stored in the specimen storage section is poured, and which stores the reverse transcription enzyme for synthesizing cDNA from the RNA stored therein using a reverse transcription reaction, and the specimen or the RNA extracted from the specimen stored in the specimen storage section and the reverse transcription enzyme stored in the reverse transcription storage section are fed to the flow path and mixed in the flow path and cDNA is synthesized and then the amplification reaction and the detection thereof is performed.

* * * * *